US008689573B2

(12) United States Patent
Zangari et al.

(10) Patent No.: US 8,689,573 B2
(45) Date of Patent: Apr. 8, 2014

(54) REFRIGERATED MERCHANDISER

(75) Inventors: Jony M. Zangari, O'Fallon, MO (US); Dennis L. Wagner, Manchester, MO (US); Mark Schaefer, Chesterfield, MO (US); Dennis L. Dickerson, O'Fallon, MO (US); Scott N. Hixson, St. Louis, MO (US); William R. North, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 435 days.

(21) Appl. No.: 13/182,142

(22) Filed: Jul. 13, 2011

(65) Prior Publication Data

US 2011/0265504 A1 Nov. 3, 2011

Related U.S. Application Data

(62) Division of application No. 11/924,645, filed on Oct. 26, 2007, now Pat. No. 7,997,094.

(60) Provisional application No. 60/863,023, filed on Oct. 26, 2006.

(51) Int. Cl.
*F25D 21/06* (2006.01)

(52) U.S. Cl.
USPC ..... 62/151; 62/80; 62/255; 62/440

(58) Field of Classification Search
USPC ..... 62/80, 89, 151, 156, 160, 190, 248, 440
See application file for complete search history.

(56) References Cited

U.S. PATENT DOCUMENTS 5,417,079 A 5/1995 Rudick et al.
5,921,082 A * 7/1999 Berling ..... 60/325
5,924,297 A * 7/1999 Wolff et al. ..... 62/152
6,411,916 B1 6/2002 Pellerin
6,685,051 B2 2/2004 Zangari et al.
7,703,295 B2 4/2010 Zangari et al.
7,997,094 B2 8/2011 Zangari et al.
2003/0218023 A1 11/2003 Zangari et al.
2007/0006604 A1 1/2007 Behr
2008/0148751 A1* 6/2008 Swofford ..... 62/210

FOREIGN PATENT DOCUMENTS

EP 1139037 10/2001
WO 03093738 11/2003

OTHER PUBLICATIONS

Notice of Allowance from the US Patent and Trademark Office for U.S. Appl. No. 13/182,158 date mailed May 24, 2013 (7 pages).

* cited by examiner

*Primary Examiner* — Melvin Jones
(74) *Attorney, Agent, or Firm* — Michael Best & Friedrich LLP

(57) ABSTRACT

A refrigerated merchandiser including a case, a refrigeration system, a sensor, and a controller. The refrigeration system is operable in a defrost mode defrosting the evaporator, and a refrigeration mode discharging a refrigerated airflow into the product storage area to refrigerate the product and to maintain the product within a predetermined temperature range without freezing the product, and to receive the refrigerated airflow along a return passageway. The sensor senses one or more defrost conditions of the case. The controller controls the refrigeration system in the refrigeration mode and in the defrost mode, and includes an algorithm for calculating when to initiate the defrost mode and for calculating a duration of the defrost mode. The controller is programmed to vary the refrigeration system between the refrigeration mode and the defrost mode based on the signals indicative of the defrost conditions and the calculations by the algorithm.

16 Claims, 10 Drawing Sheets

REFRIGERATED MERCHANDISER

RELATED APPLICATIONS

This patent application claims priority to U.S. patent application Ser. No. 11/924,645, filed Oct. 26, 2007, which claims priority to U.S. Patent Application Ser. No. 60/863,023, filed Oct. 26, 2006, the entire contents of which are hereby incorporated by reference.

BACKGROUND

The present invention relates to a control system for a refrigerated merchandiser. More specifically, the present invention relates to a control system that cools product in the refrigerated merchandiser within a predetermined temperature range based on a freezing temperature of the product.

In conventional practice, supermarkets and convenience stores are equipped with refrigerated merchandisers that have cases to store and present product (e.g., beverages) on shelves in a product display area available to customers. Typically, refrigerated merchandisers include a refrigeration system that directs cool, refrigerated air into the product display area to keep the product cold. However, existing merchandisers direct the refrigerated air directly toward the product. In existing merchandisers that include multiple vertically-stacked shelves, the refrigerated air is directed toward the uppermost shelves. This often causes the product on the uppermost shelves to be relatively cold and the product on the lowermost shelves to be relatively warm. These merchandisers compensate for the warm product on the lower shelves by decreasing the temperature of the refrigerated air. However, decreasing the temperature can freeze the product stored on the upper shelves.

Existing cases are often designed to store large quantities of product on the shelves without regard to airflow patterns within the case that are necessary to adequately cool the product. These large quantities of product often impede the flow of refrigerated air through the case, which causes the temperature of the product to be substantially variable at different areas of the case. In addition, the airflow within these cases can be substantially turbulent, further contributing to a relatively large temperature distribution of the product.

Some existing cases include a mechanical thermostat to control the temperature of the product. These mechanical thermostats often have a wide temperature differential between "ON" and "OFF" states due to the lack of precision inherent in these mechanical thermostats. As a result, the temperature of the product fluctuates over a relatively large temperature range, which can adversely impact the quality of the product.

Some cases use the temperature of the air in the product display area to represent the temperature of the product. However, the temperature of the air in the product display area does not provide an accurate indication of the product temperature. The temperature of the air in the product display area can be adversely affected by door openings and defrost of the refrigeration system, which can warm the air in the case. Opening the door and defrosting the refrigeration system often increases the temperature of the air surrounding the product, but does not necessarily change the temperature of the product itself.

SUMMARY

In one embodiment, the invention provides a refrigerated merchandiser that includes a case, a refrigeration system, at least one sensor, a controller, and a display. The case defines a product storage area and includes at least one product support that supports product in the product storage area. The refrigeration system is in communication with the product storage area, and discharges a refrigerated airflow into the product storage area to refrigerate the product. The refrigeration system includes a refrigeration circuit that has a compressor, a condenser, and an evaporator in series. The sensor is in communication with the refrigerated airflow to sense an airflow temperature and to generate a signal indicative of the airflow temperature. The controller is in electrical communication with the sensor to receive the signal indicative of the airflow temperature, and includes an algorithm that calculates a temperature of the product based on the signal indicative of the airflow temperature. The display is coupled to the case and is visible from outside the case, and is in electrical communication with the controller to show the calculated product temperature.

In another embodiment, the invention provides a method of calculating a temperature of product supported in a product storage area of a refrigerated merchandiser. The refrigerated merchandiser including a case defining a product storage area, and a refrigeration system in communication with the product storage area to introduce a refrigerated airflow into the product storage area along a discharge passageway to refrigerate the product, and to receive the refrigerated airflow from the product storage area along a return passageway. The method includes sensing a temperature of the refrigerated airflow and generating a signal indicative of the airflow temperature, initializing an initial product temperature using a controller based on the signal indicative of the airflow temperature, and calculating a final product temperature with an algorithm of the controller based at least in part on the initial product temperature and the sensed airflow temperature. The method also includes displaying the calculated final product temperature on a display that is visible from outside the case.

In yet another embodiment, the invention provides a refrigerated merchandiser that includes a case that defines a product storage area and that includes at least one product support that supports product in the product storage area. The refrigerated merchandiser also includes a refrigeration system, a first sensor, a second sensor, and a controller. The refrigeration system is in communication with the product storage area, and discharges a refrigerated airflow into the product storage area to refrigerate the product. The refrigeration system includes a refrigeration circuit that has a compressor, a condenser, and an evaporator in series. The refrigeration system is operable in a first refrigeration mode that has a first set of predetermined parameters and a second refrigeration mode that has a second set of predetermined parameters that are different from the first set of predetermined parameters. The first sensor is in communication with the refrigerated airflow to sense an airflow temperature within the product storage area and to generate a first signal indicative of the airflow temperature. The second sensor is configured to sense an ambient air temperature and to generate a second signal indicative of the ambient air temperature. The controller is in electrical communication with the first sensor and the second sensor to receive the first signal and the second signal, and is in communication with the refrigeration system to operate the refrigeration system based at least in part on the first signal and the second signal. The controller is programmed to operate the refrigeration system in the first refrigeration mode in response to the sensed ambient air temperature at or above a predetermined temperature, and to operate the refrigeration system in the second refrigeration mode in response to the sensed ambient air temperature below the predetermined temperature to avoid freezing the product.

In yet another embodiment, the invention provides a refrigerated merchandiser that includes a case, a refrigeration system, a first sensor, a second sensor, and a controller. The case defines a product storage area and includes at least one product support that supports product in the product storage area. The product is known and has a predetermined freezing temperature of approximately 19 degrees Fahrenheit. The refrigeration system is in communication with the product storage area to introduce a refrigerated airflow into the product storage area along a discharge passageway to refrigerate the product, and to receive the refrigerated airflow from the product storage area along a return passageway. The refrigeration system includes a refrigeration circuit that has a compressor, a condenser, and an evaporator in series. The first sensor is in communication with the refrigerated airflow in the discharge passageway to sense a discharge airflow temperature and to generate a signal indicative of the discharge airflow temperature. The second sensor is in communication with the refrigerated airflow in the return passageway to sense a return airflow temperature and to generate a signal indicative of the return airflow temperature. The controller is in electrical communication with the first sensor and the second sensor to receive the signal indicative of the discharge airflow temperature and the signal indicative of the return airflow temperature. The controller is in communication with the refrigeration system to control a temperature of the product within a predetermined temperature range that is between about 22 degrees Fahrenheit and 23 degrees Fahrenheit based on at least one of the signal indicative of the discharge airflow temperature and the signal indicative of the return airflow temperature. The controller is further programmed to operate the refrigeration system such that the discharge airflow temperature is maintained above a temperature between about 10 degrees Fahrenheit and 30 degrees Fahrenheit to regulate an evaporation temperature of the evaporator to avoid freezing the product.

In yet another embodiment, the invention provides a refrigerated merchandiser that includes a case, a refrigeration system, at least one sensor, and a controller. The case defines a product storage area and includes at least one product support that supports product in the product storage area. The refrigeration system is in communication with the product storage area to discharge a refrigerated airflow into the product storage area to refrigerate the product and to maintain the product within a predetermined temperature range. The refrigeration system includes a refrigeration circuit that has a compressor, a condenser, and an evaporator in series. The sensor is coupled to the case and senses one or more conditions of the case, and generates one or more signals indicative of the conditions of the case. The controller is in electrical communication with the sensor to receive the signals indicative of the conditions of the case, and is in communication with the refrigeration system to acquire and record data from the refrigeration system. The controller includes a failsafe mode that controls the refrigeration system based on prior recorded data in response to a failure of the sensor to maintain the product within the predetermined temperature range.

In yet another embodiment, the invention provides a refrigerated merchandiser that includes a case, a refrigeration system, a sensor, and a controller. The case defines a product storage area, and includes a door that provides access to the product storage area, and at least one product support that supports product in the product storage area. The refrigeration system is in communication with the product storage area and includes a refrigeration circuit that has a compressor, a condenser, and an evaporator in series. The refrigeration system is operable in a refrigeration mode that discharges a refrigerated airflow into the product storage area along a discharge passageway to refrigerate the product and to maintain the product within a predetermined temperature range without freezing the product. The refrigeration system receives the refrigerated airflow from the product storage area along a return passageway, and is further operable in a defrost mode that defrosts the evaporator. The sensor is coupled to the case and senses one or more defrost conditions of the case, and generates one or more signals indicative of the defrost conditions. The controller is in electrical communication with the sensor to receive the signals indicative of the defrost conditions, and is in communication with the refrigeration system to control the refrigeration system in the refrigeration mode and in the defrost mode. The controller includes an algorithm for calculating when to initiate the defrost mode, and for calculating a duration of the defrost mode. The controller is programmed to vary the refrigeration system between the refrigeration mode and the defrost mode based on the signals indicative of the defrost conditions and the calculations by the algorithm.

In yet another embodiment, the invention provides a refrigerated merchandiser that includes a case and a refrigeration system. The case defines a product storage area and includes at least one product support that supports product in the product storage area. The case also includes a case top, a discharge passageway, and a return passageway. The case top has a lower wall, a front wall, and a deflector. The refrigeration system is in communication with the product storage area, and includes a refrigeration circuit that has a compressor, a condenser, and an evaporator in series. The evaporator is disposed in the case top. The refrigeration system also includes a fan that cooperates with the lower wall, the front wall, and the deflector to discharge a substantially laminar refrigerated airflow into and through the product storage area to refrigerate the product within a predetermined temperature range without directing the refrigerated airflow directly at the product.

In yet another embodiment, the invention provides a refrigerated merchandiser that includes a case, a refrigeration system, a dispenser rack, and a dispenser door. The case defines a product storage area and a product dispenser opening, and includes a door and a product receiving tray disposed adjacent a front portion of the case. The refrigeration system is in communication with the product storage area, and discharges a refrigerated airflow into the product storage area to refrigerate product stored in the product storage area within a predetermined temperature range. The refrigeration system includes a refrigeration circuit that has a compressor, a condenser, and an evaporator in series. The dispenser rack is coupled to the case and includes a wireframe housing that defines a product travel path and that supports the product within the product travel path. The product travel path is defined by a serpentine passage that alternatingly guides the product in a generally downward direction toward the product dispenser opening. The dispenser rack also includes a loading portion for loading the product into the case, and a dispenser mechanism that is disposed adjacent an end of the product travel path and in communication with the product dispenser opening. The dispenser door is disposed adjacent the dispenser mechanism and proximate to the product dispenser opening. The dispenser door is in communication with the tray, and includes an axle pivotably coupled to the case and a receiving portion that receives the product dispensed by the dispenser mechanism. The dispenser door is pivotable between a closed position and an open position about the axle.

The receiving portion is in close proximity to the tray when the dispenser door is in the open position. The product dispensed by the dispenser mechanism and disposed in the receiving portion remains engaged with the receiving portion until the dispenser door is pivoted to the open position where a center of gravity of the product extends beyond an edge of the receiving portion to dispense the product from the receiving portion into the tray while substantially limiting agitation of the product during dispensation.

In yet another embodiment, the invention provides a refrigerated merchandiser includes a case, a refrigeration system, a dispenser rack, and at least one separator. The case defines a product storage area and a product dispenser opening, and includes a door. The refrigeration system is in communication with the product storage area, and discharges a refrigerated airflow into the product storage area to refrigerate product stored in the product storage area within a predetermined temperature range. The refrigeration system includes a refrigeration circuit that has a compressor, a condenser, and an evaporator in series. The dispenser rack is coupled to the case and includes a wireframe housing that defines a product travel path and that supports the product within the product travel path. The product travel path is defined by a serpentine passage that alternatingly guides the product in a generally downward direction toward the product dispenser opening. The dispenser rack also includes a loading portion for loading the product into the case, and a dispenser mechanism disposed adjacent an end of the product travel path. At least one separator is coupled to the dispenser rack and is in communication with the product travel path. The separator is rotatable about an axis in response to engagement by the product in the product travel path, and is configured to guide the product along the product travel path toward the dispenser mechanism.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
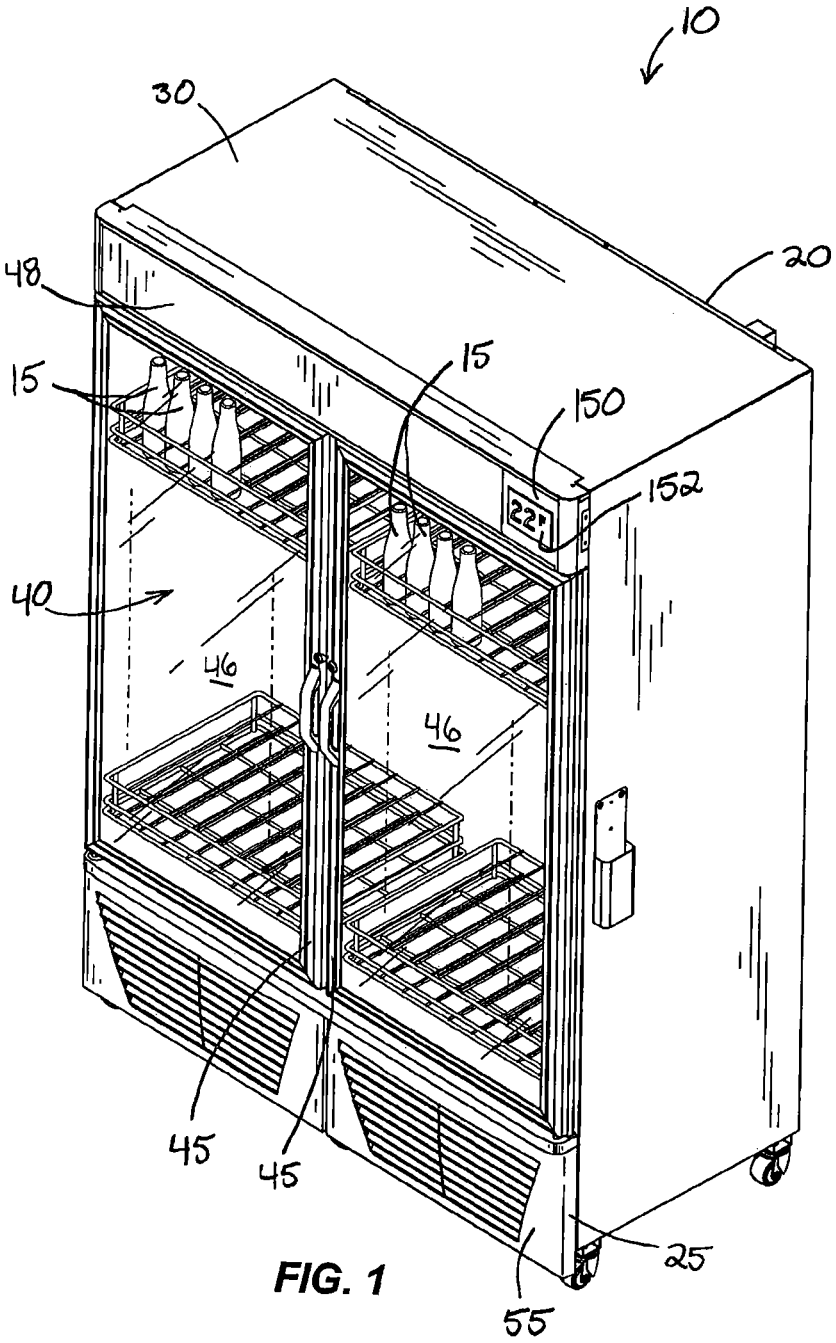
FIG. 1 is a perspective view of a refrigerated merchandiser embodying the present invention.

FIG. 1 shows a refrigerated merchandiser 10 that may be located in a supermarket or a convenience store (not shown) or other locations for presenting beverages or product 15 (e.g., beer, soda, etc.) to consumers. In the illustrated construction, the product 15 is a known product that includes a container (e.g., aluminum casing, glass casing, etc.) that stores a fluid, and that has a known or predetermined freezing temperature. The predetermined freezing temperature is approximately 19 degrees Fahrenheit. In other constructions, the product may have a predetermined freezing temperature that is warmer or colder than 19 degrees Fahrenheit. The refrigerated merchandiser 10 includes a case 20 that has a base 25, a case top 30, and a rear wall 35. The area partially enclosed by the base 25, the case top 30, and the rear wall 35 defines a product display area or product storage area 40 that stores the product 15.

Two doors 45 are pivotally attached to the case 20 to allow access to the product 15 stored in the product storage area 40. Each of the doors 45 includes a glass member 46 that allows viewing of the product 15 by consumers from outside the case 20. The doors 45 also include a coating (not shown) that is electrically heated to limit condensation and fogging of the glass member 46 due to temperature variances that may exist between the product storage area 40 and an environment surrounding the refrigerated merchandiser 10. In some constructions, the case 20 may include one door 45, or more than two doors 45 that allow access to the product storage area 40.

Figure 2:
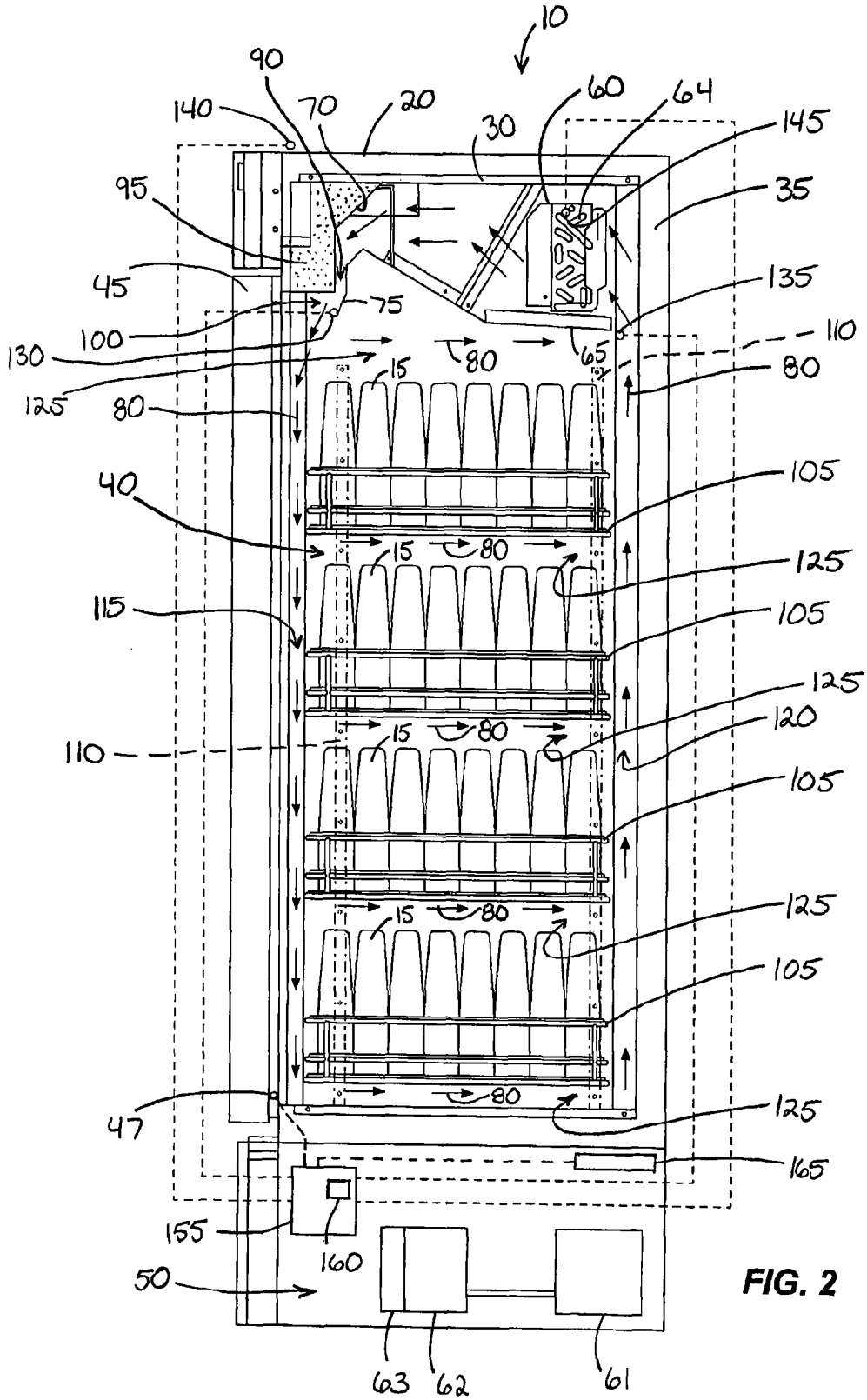
FIG. 2 is a schematic view of the refrigerated merchandiser of FIG. 1.

As shown in FIG. 2, a door switch 47 can be positioned adjacent the doors 45 to sense a condition of the doors 45. For example, the door switch 47 can sense when the at least one of the doors 45 is in an open position, and when at least one of the doors 45 is in a closed position.

Referring back to FIG. 1, a light assembly 48 is coupled to the case 20 adjacent the case top 30. The light assembly is further coupled to the case 20 substantially above the doors 45 to at least partially illuminate the product storage area 40. The light assembly 48 is generally known and will not be discussed in detail.

FIG. 2 shows the refrigerated merchandiser 10 that also includes a refrigeration system 50 to refrigerate the product 15. The refrigeration system 50 is in fluid communication with the product storage area 40 to provide refrigerated air that cools the product 15 to a temperature within a predetermined temperature range (e.g., 22-23 degrees Fahrenheit, etc.). The product 15 is maintained at temperatures within the predetermined temperature range so that the product 15 is most desirable to consumers.

The refrigeration system 50 includes an evaporator 60, at least one evaporator fan (not shown), a compressor 61, a condenser 62, and at least one condenser fan 63 that are coupled in series and that form a closed refrigeration circuit within the refrigerated merchandiser 10. The compressor 61, the condenser 62, and the condenser fan 63 are located in the base 25, and are accessible through a panel 55 attached to a front of the base 25.

The evaporator 60 and the evaporator fan are located in the case top 30 above the product storage area 40. The evaporator 60 includes an evaporator coil 64 to provide heat transfer between a refrigerant flowing through the refrigeration system 50 and air flowing over the evaporator coil 64. The evaporator 60 is fluidly coupled to the compressor 61 and the condenser 62 via tubing (not shown) that extends downward from the evaporator 60 into the base 25 along the rear wall 35. A channel or other covering (not shown) can be used to at least partially obscure the tubing from view.

The case top 30 is positioned substantially above the product storage area 40, and includes a lower wall 65, a front wall 70, and a deflector 75. The lower wall 65 separates the evaporator 60 from the product storage area 40 and generally directs the refrigerated airflow (e.g., indicated throughout the refrigerated merchandiser 10 by the arrows 80) from the evaporator 60 toward the front wall 70. A middle portion of the lower wall 65 is angled generally upward away from the evaporator 60 in the direction of airflow. An end portion of the lower wall 65 extends generally downward from an end of the middle portion, and is spaced from the front wall 70 to define an inlet passageway 90 that fluidly couples the case top 30 with the product storage area 40.

The front wall 70 is positioned adjacent a front of the case top 30. A portion of the front wall 70 is angled generally downward in the direction of airflow to redirect the refrigerated airflow into the inlet passageway 90. Insulation 95 is positioned between the panel 55 and the front wall 70 to insulate the refrigerated airflow from the light assembly 48 and the warmer air in the environment surrounding the merchandiser 10.

The deflector 75 is attached to an end of the end portion of the lower wall 65, and extends toward a front of the case 20. The deflector 75 is spaced from the front wall 70 to define an air discharge outlet 100 in fluid communication with the inlet passageway 90. In some constructions, the case 20 can include airflow control sheets that are defined in part by deflector 75 and the inlet passageway 90, and that generate a high pressure refrigerated airflow zone and a low pressure refrigerated airflow zone into the product storage area 40. The airflow control sheets are defined by narrow channels that extend across a substantial width of the discharge outlet 100 to generate the different airflow zones within the product storage area. The high pressure refrigerated airflow zone is generally directed toward a lower portion of the product storage area 40 to refrigerate the product 15. The low pressure refrigerated airflow zone is generally directed toward an upper portion of the product storage area 40 to refrigerate the product 15.

FIGS. 1 and 2 show that the case 20 further includes shelves or product supports 105 that are positioned within the product storage area 40 to support the product 15. The shelves 105 are supported by brackets 110 attached to side walls of the case 20. The shelves 105 can be vertically spaced various distances from each other using the brackets 110 to accommodate various sizes of product 15. In the refrigerated merchandiser 10 illustrated in FIG. 2, the case 20 includes four shelves 105. In other constructions, the case 20 may include more or fewer than four shelves 105.

Figure 3:
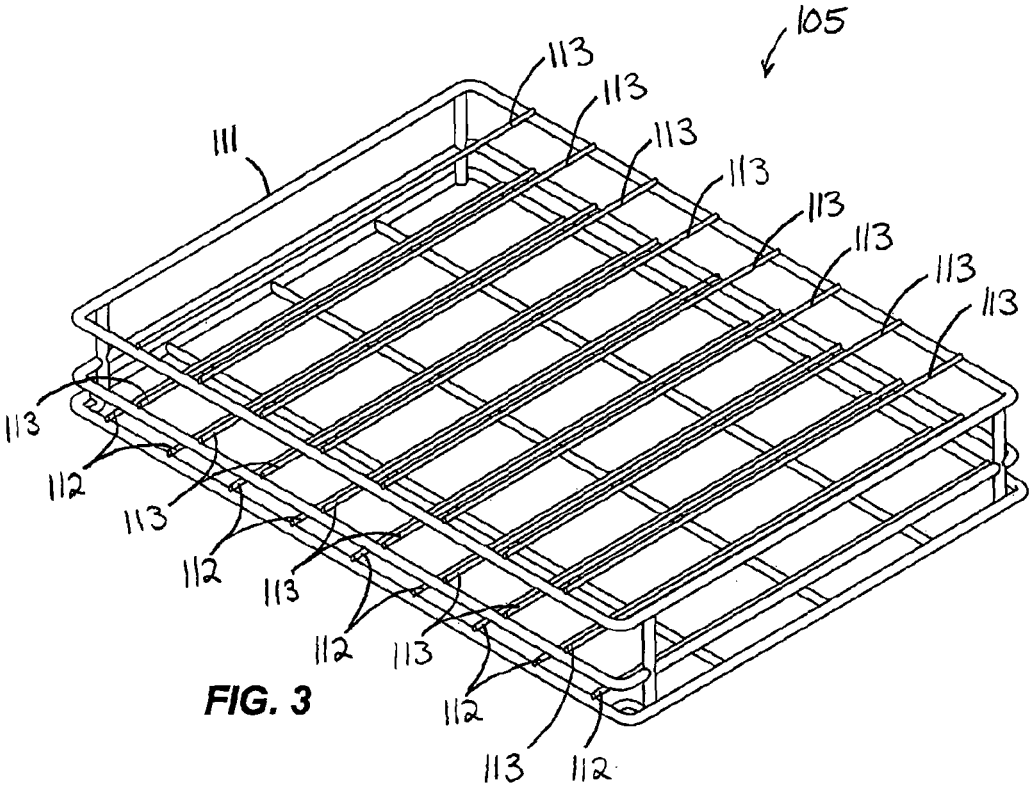
FIG. 3 is a perspective view of a product support of the refrigerated merchandiser of FIG. 1.
Figure 4:
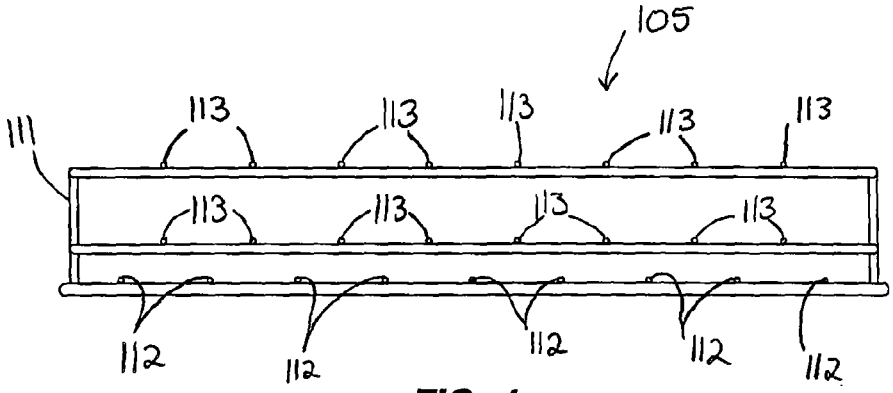
FIG. 4 is a front view of the product support of FIG. 3.

In some constructions, one or more of the shelves 105 may receive only certain sizes of product 15 (e.g., a container of a particular size). For example, the shelves 15 can be used to hold a specifically sized container that maximizes distribution of the refrigerated airflow over the product 15. FIGS. 3 and 4 show that the shelves 105 include a frame 111, wire supports 112, and wire separators 113 that are formed by wire or other material to accommodate the specific size of the product 15 to be stored or displayed. The wire supports 112 support the product 15, and the wire separators 113 engage sides of the product 15 to support the product 15 in a substantially vertical orientation. The wire separators 113 also inhibit display of product that has sizes different from the size of the product 15 desired to be displayed in the case 20.

Referring back to FIG. 2, a forward portion of the shelves 105 adjacent the doors 45 are spaced a distance from the doors 45 to form a discharge passageway or duct 115. The discharge passageway 115 extends between the case top 30 and the base 25 to distribute the refrigerated airflow to the product storage area 40.

A rear portion of the shelves 105 adjacent the rear wall 35 are spaced a distance from the rear wall 35 to form an air return passageway or duct 120. The return passageway 120 extends between the base 25 and the case top 30 to direct air toward the evaporator 60.

The refrigerated airflow from the discharge passageway 115 is evenly distributed over the product 15 and is in fluid communication with the return passageway 120 via intermediate passageways or ducts 125. Each of the intermediate passageways 125 is defined on an upper side by one of the shelves 105. The lowermost intermediate passageway 125 is defined on a lower side by a wall of the base 25, and the remaining intermediate passageways 125 are defined on a lower side by upper portions of the product 15.

The case 20 further includes an air discharge sensor 130, an air return sensor 135, an ambient air sensor 140, a defrost sensor 145, a display 150, and a controller 155. The sensors 130, 135, 140, 145 of the illustrated case 20 are digital temperature sensors that maintain a high degree of accuracy (e.g., ±1 degrees Fahrenheit, etc.). In other constructions, one or more of the sensors 130, 135, 140, 145 can be non-digital temperature sensors capable of a high degree of sensing accuracy. In some constructions, the case 20 may include one or more additional sensors (not shown) to sense various conditions of the refrigerated merchandiser 10 and the surrounding environment.

The discharge sensor 130 is in communication with the refrigerated air flow adjacent the discharge outlet 100 to sense a temperature of the refrigerated airflow and to deliver a signal indicative of that temperature to the controller 155. The return sensor 135 is in communication with the return airflow adjacent the return passageway 120 to sense a temperature of the return airflow and to deliver a signal indicative of that temperature to the controller 155.

The ambient sensor 140 is in communication with the environment surrounding the refrigerated merchandiser 10 to sense the ambient temperature and other conditions of the environment and to deliver a signal indicative of those conditions to the controller 155. In the illustrated construction, the ambient sensor 140 is placed in communication with the environment adjacent a top of the case 20 to sense conditions of the environment surrounding the refrigerated merchandiser 10. In other constructions, the ambient sensor 140 may be located outside the case 20 adjacent the condenser 62.

The defrost sensor 145 is coupled to the evaporator 60 in communication with the evaporator coil 64 to sense defrost conditions of the evaporator 60. In other constructions, the defrost sensor 145 may be located remotely from the evaporator 60 to sense other defrost conditions. The defrost sensor 145 is configured to sense a temperature of the evaporator coil 64, and to deliver a signal indicative of that temperature to the controller 155. In other constructions, the defrost conditions may include a temperature of the refrigerated airflow in the return passageway 120, or a position of the doors 45.

The display 150 is attached to the case 20 adjacent the case top 30 and the light assembly 48. FIG. 1 shows the display 150 located on a right side of the light assembly 48. In other constructions, the display 150 can be located on the left side of the light assembly 48. In still other constructions, the display 150 can be located on other parts of the case 20 such that the temperature of the product 15 can be visible to consumers.

The display 150 includes a screen 152 that shows a calculated temperature of the product 15 so that the temperature is visible to consumers. The illustrated display 150 is an electronic light emitting diode ("LED") display. However, one of ordinary skill in the art would recognize that other types of displays are possible that are within the scope of the invention.

The controller 155 is located in the base 25 adjacent the front of the case 20, and includes a memory 160. In some constructions, the controller 155 may be located remotely from the case 20. The controller 155 is in electrical communication with the doors 45 to control electrical power flowing through the coating on the glass member 46. The electrical power can be controlled manually or automatically by the controller 155 such that the desired defogging and anti-condensation properties of the doors 45 are achieved. The controller 155 can be programmed during or after setup to provide adequate electrical power to the coating based on various ambient conditions sensed in the surrounding environment. In other constructions, the electrical power supplied to the coating may be determined based on conditions of the airflow determined by the return sensor 135. In still other constructions, the electrical power supplied to the coating may be determined by the door switch 47 in communication with the doors 45 (e.g., to indicate open and closed positions).

The controller 155 is also in electrical communication with the refrigeration system 50, the discharge sensor 130, and the return sensor 135 to maintain the temperature of the product 15 within the predetermined temperature range. More specifically, the controller 155 selectively controls the refrigeration components (e.g., the evaporator 60, the compressor 61, the evaporator fan, the condenser 62) in respective "ON" states and "OFF" states in response to the various signals received from the sensors 130, 135.

In some constructions, the controller 155 maintains the temperature of the product 15 within the predetermined temperature range based on the signal indicative of the return air temperature from the return sensor 135. The controller 155 determines a change in the return air temperature and adjusts the refrigeration system 50 to maintain the product temperature within the predetermined temperature range. In other constructions, the controller 155 can maintain the temperature of the product 15 within the predetermined temperature range based on the signal indicative of the discharge air temperature from the discharge sensor 130. In still other constructions, the controller 155 may maintain the temperature of the product 15 within the predetermined temperature range based on the signal indicative of the environment conditions from the ambient sensor 140 based on one or more pre-set ambient conditions.

For example, in some constructions, a low temperature kit can be provided for the refrigerated merchandiser 10 to operate the case 20 when the temperature of ambient air is below about 50 degrees Fahrenheit. The low temperature kit can be installed in the refrigerated merchandiser 10 in retrofit applications or, alternatively, in the original refrigerated merchandiser 10.

The low temperature kit includes the ambient sensor 140 that detects the ambient air temperature, and the controller 155 that receives the signal indicative of the ambient air temperature from the ambient sensor 140. Alternatively, the low temperature kit may include a sensor and a controller that are different from the ambient sensor 140 and the controller 155, respectively. Generally, as described above, the ambient sensor 140 in the low temperature kit can be located proximate to the condenser 52 to sense the ambient air temperature of ambient air flowing over the condenser 52, or alternatively, can be located in other areas on or off the case 20 to sense the ambient air temperature.

In constructions of the refrigerated merchandiser 10 that include the low temperature kit, the refrigeration system 50 includes a first refrigeration mode and a second refrigeration mode. The first refrigeration mode has a first set of predetermined parameters that are stored in the controller 155. The second refrigeration mode has a second set of predetermined parameters that are stored in the controller 155, and that are different from the first set of predetermined parameters. The controller 155 is in electrical communication with the discharge sensor 130 and the air return sensor 135, in addition to the ambient sensor 140 to operate the refrigeration system 50 in one of the first refrigeration mode and the second refrigeration mode based at least in part on one or more of the signals indicative of the discharge airflow temperature and the return airflow temperature, and the ambient air temperature.

In some constructions, the first set of predetermined parameters includes a first compressor setpoint and a second compressor setpoint. The second set of predetermined parameters includes a third compressor setpoint and a fourth compressor setpoint that are warmer than the first and second compressor setpoints. The first and second compressor setpoints define a first range of temperatures on which operation of the compressor 61 is based. The third and fourth compressor setpoints define a second range of temperatures on which operation of the compressor 61 is based. The first, second, third, and fourth compressor setpoints relate to a temperature of refrigerant that flows through the compressor 61. Alternatively, the first, second, third, and fourth compressor setpoints can relate to a pressure of refrigerant flowing through the compressor 61.

The first, second, third, and fourth compressor setpoints can be any temperature or pressure of the refrigerant that refrigerates the product 15 without freezing the product 15. For example, the first compressor setpoint can be approximately 20 degrees Fahrenheit, and the second compressor setpoint can be approximately 23 degrees Fahrenheit, thus defining a first range of temperatures between 20 and 23 degrees Fahrenheit. Generally, the third compressor setpoint is warmer than the first compressor setpoint, and the fourth compressor setpoint is warmer than the second compressor setpoint. For example, the third compressor setpoint can be approximately 22 degrees Fahrenheit, and the fourth compressor setpoint can be approximately 25 degrees Fahrenheit, defining a second range of temperatures between 22 and 23 degrees Fahrenheit. Other temperatures for the first, second, third, and fourth compressor setpoints are also possible and considered herein.

The controller 155 is in communication with the compressor 61 to operate the compressor 61 in the first refrigeration mode between the first compressor setpoint and the second compressor setpoint to maintain the temperature of the product 15 within the predetermined temperature range without freezing the product 15 when the ambient temperature is above the predetermined temperature (e.g., 50 degrees Fahrenheit). The controller 155 operates the compressor 61 in the second refrigeration mode between the third compressor setpoint and the fourth compressor setpoint to maintain the temperature of the product 15 within the predetermined temperature range without freezing the product 15 when the ambient temperature is below the predetermined temperature.

In other words, the controller 155 varies the compressor 61 between an "On" state and an "Off" state in the first refrigeration mode based on the first and second compressor setpoints. The controller 155 varies the compressor 61 between the "On" state and the "Off" state in the second refrigeration mode based on the third and fourth compressor setpoints. When the temperature of refrigerant in the compressor 61 exceeds the second or fourth compressor setpoint, the controller 155 varies the compressor 61 from the "Off" state to the "On state, and varies the compressor 61 to the "Off" state only when the temperature of the refrigerant is lower than the first and third compressor setpoints.

In other constructions, the first set of predetermined parameters includes a first airflow temperature setpoint and a second airflow temperature setpoint. The second set of predetermined parameters includes a third airflow temperature setpoint and a fourth airflow temperature setpoint. The first, second, third, and fourth airflow temperature setpoints relate to a temperature of the refrigerated airflow in the discharge passageway 115. Alternatively, the first, second, third, and fourth airflow temperature setpoints can relate to a temperature of the refrigerated airflow in the return passageway 120. The first and second airflow temperature setpoints define a first range of temperatures on which operation of the refrigeration system 50 is based. The third and fourth compressor setpoints define a second range of temperatures on which operation of the refrigeration system 50 is based. In some constructions, the first set of predetermined parameters can include the first and second compressor setpoints and the first and second airflow temperature setpoints. Similarly, the second set of predetermined parameters can include the third and fourth compressor setpoints and the third and fourth airflow temperature setpoints.

The first, second, third, and fourth airflow temperature setpoints can be any temperature that refrigerates the product 15 without freezing the product 15. For example, the first airflow temperature setpoint can be approximately 15 degrees Fahrenheit, and the second airflow temperature setpoint can be approximately 18 degrees Fahrenheit, thus defining the first range of temperatures between 15 and 18 degrees Fahrenheit. Generally, the third airflow temperature setpoint is warmer than the first airflow temperature setpoint, and the fourth airflow temperature setpoint is warmer than the second airflow temperature setpoint. For example, the third airflow temperature setpoint can be approximately 17 degrees Fahrenheit, and the fourth airflow temperature setpoint can be approximately 20 degrees Fahrenheit, defining the second range of temperatures between 17 and 20 degrees Fahrenheit. Other temperatures for the first, second, third, and fourth airflow temperature setpoints are also possible and considered herein.

In constructions that include the first, second, third, and fourth airflow temperature setpoints, the controller 155 is in communication with the refrigeration system 50 to vary the refrigeration system 50 between the first refrigeration mode and the second refrigeration mode based on the sensed ambient air temperature. The controller 155 operates the refrigeration system 50 in the first refrigeration mode between the first airflow temperature setpoint and the second airflow temperature setpoint to maintain the temperature of the product 15 within the predetermined temperature range without freezing the product 15 when the ambient temperature is above the predetermined temperature. The controller 155 operates the refrigeration system 50 in the second refrigeration mode between the third airflow temperature setpoint and the fourth airflow temperature setpoint to maintain the temperature of the product 15 within the predetermined temperature range without freezing the product 15 when the ambient temperature is below the predetermined temperature.

The controller 155 varies one or more components of the refrigeration system 50 between an "On" state and an "Off" state in the first refrigeration mode based on the first and second airflow temperature setpoints. The controller 155 varies the components between the "On" state and the "Off" state in the second refrigeration mode based on the third and fourth airflow temperature setpoints. When the temperature of the refrigerated airflow in the discharge passageway 115 or the return passageway 120 exceeds the second or fourth airflow temperature setpoint, the controller 155 varies the components from the "Off" state to the "On state, and varies the components back to the "Off" state only when the temperature of the refrigerated airflow in the discharge passageway 115 or the return passageway 120 is lower than the first and third airflow temperature setpoints. In warm ambient conditions (e.g., at or above 50 degrees Fahrenheit), the controller 155 is programmed to control the refrigeration system 50 based on the temperature of the refrigerated airflow in the return passageway 120. In cold ambient conditions (e.g., when the ambient air temperature is below 50 degrees Fahrenheit), the controller 155 is programmed to control the refrigeration system based on the temperature of the refrigerated airflow in the discharge passageway 115.

The controller 155 is programmed to adjust the second set of predetermined parameters based on the sensed ambient air temperature. Generally, the values for the third and fourth compressor setpoints, and the third and fourth airflow temperature setpoints are dependent on the ambient air temperature that is sensed by the ambient sensor 140. In other words, the third and fourth compressor setpoints and the third and fourth airflow temperature setpoints are adjustable by the controller 155 in response to the sensed ambient air temperature.

For example, when the ambient air temperature is approximately 45 degrees Fahrenheit, the third and fourth compressor setpoints define a temperature range between about 23 degrees Fahrenheit and 26 degrees Fahrenheit, and the third and fourth airflow temperature setpoints define a temperature range between about 18 degrees Fahrenheit and 21 degrees Fahrenheit. When the ambient air temperature is colder than 45 degrees Fahrenheit, the third and fourth compressor setpoints are adjusted to be warmer than 23 and 26 degrees Fahrenheit, respectively, by the controller 155. Similarly, the third and fourth airflow temperature setpoints are adjusted to be warmer than 18 and 21 degrees Fahrenheit, respectively, by the controller 155 when the ambient air temperature is colder than 45 degrees Fahrenheit. When the ambient air temperature is warmer than 45 degrees Fahrenheit, the respective setpoints are adjusted to be colder than the setpoints at 45 degrees Fahrenheit. The foregoing example is for illustrative purposes only, and does not limit the scope of the invention.

When the ambient air temperature is below a threshold temperature, the product 15 in the product storage area 40 may freeze. This situation may occur when the refrigerated merchandiser 10 is used in outdoor applications. In some constructions, the refrigerated merchandiser 10 includes a heater 165 that is in communication with the product storage area 40 to distribute heat into the product storage area 40 to maintain the temperature of the product 15 above the freezing temperature of the product 15. In these constructions, the controller 155 is programmed to initiate the heater 165 for a predetermined time to warm the product storage area 40 when the ambient air temperature is below the threshold temperature. The heater 165 can be a defrost heater, or another heater that is coupled to the case 20 and in communication with the product storage area 40. In some constructions, the threshold temperature is approximately 20 degrees Fahrenheit. In other constructions, the threshold temperature may be warmer or colder than 20 degrees Fahrenheit.

The controller 155 is further in electrical communication with the display 150 to deliver a signal indicative of the calculated product temperature to the screen 152. The controller 155 includes a temperature algorithm that determines the temperature of the product 15 based in part on the return air temperature sensed by the return sensor 135. In other constructions, the controller 155 may calculate the product temperature based in part on other signals (e.g., based on the temperature of the air flowing through the discharge outlet 100).

The temperature algorithm is defined such that the temperature of the product 15 can be determined within a relatively accurate temperature range (e.g., +/−1 degree Fahrenheit) during all operating conditions of the case 20 (e.g., pull-down, steady state operation, door opened, defrost, etc.). The temperature algorithm can incorporate tuned damping to accurately reflect the temperature of the product 15, and to control a desired setpoint temperature of the product 15. In some constructions, the tuned damping incorporated by the temperature algorithm includes a coefficient that is variable based on whether a temperature of the refrigerated airflow is rising or falling. In these constructions, the temperature algorithm determines the product temperature based on the variable coefficient. For example, the temperature algorithm can determine the product temperature using the following logic or equation:

$$SST_2 = SST_1 + ((TEMP_RA + DIFF - SST_1) * (FACTOR_F) * (K))$$

Where:

SST_2=Final Software Simulated Product Temperature

SST_1=Initial Software Simulated Product Temperature

TEMP_RA=Return Air Temperature

DIFF=Control Temperature Differential Constant

K=Coefficient

If TEMP_RA is rising, or if (Temp_RA−SST_1)≥0, then K=FACTOR_R

Else, K=1.0

FACTOR_R=Rising Temperature Weight Factor Constant

FACTOR_F=Falling Temperature Weight Factor Constant

The controller 155 determines the product temperature by running the temperature algorithm. The temperature algorithm calculates the product temperature by first initializing the initial software simulated product temperature SST_1. More specifically, the initial software simulated product temperature SST_1 is equal to the return air temperature TEMP_RA sensed by the return sensor 135. When the return air temperature TEMP_RA sensed by the return sensor 135 is generally increasing or rising above a first temperature (e.g., 45 degrees Fahrenheit), the coefficient K equals the rising temperature weight factor constant FACTOR_R. Similarly, when the return air temperature TEMP_RA sensed by the return sensor 135 less the initial software simulated product temperature SST_1 is greater than or equal to zero ("0"), the coefficient K equals the rising temperature weight factor constant FACTOR_R. Otherwise, the coefficient K equals one ("1.0"). Generally, the coefficient K is based on known product, such as the product 15.

In the illustrated temperature algorithm discussed above, the control temperature differential constant DIFF is set to 0 degrees Fahrenheit. The rising temperature weight factor constant FACTOR_R is equal to 0.1, and the falling temperature weight factor constant FACTOR_F is equal to 0.25. In other constructions, the values of the control temperature differential constant DIFF can be temperatures other than 0 degrees Fahrenheit, and the rising and falling temperature weight factor constants FACTOR_R and FACTOR_F can be values other than 0.1 and 0.25, respectively. One of ordinary skill in the art should recognize that these values can be changed based on equations used to simulate or calculate the product temperature that may be different from the equation discussed above.

Once the initial software simulated product temperature SST_1 has been established, the algorithm determines the final software simulated product temperature SST_2 based on the values of the initial software simulated product temperature SST_1, the return air temperature TEMP_RA, the control temperature differential constant DIFF, the coefficient K, and the falling temperature weight factor constant FACTOR_F.

The product temperature can be calculated by the controller 155 using the temperature algorithm over any time interval (e.g., 30 seconds, 1 minute, 3 minutes, etc.). In some constructions, the temperature algorithm may truncate the calculated product temperature to the nearest whole-number temperature. The controller 155 calculates the temperature of the product 15 using the temperature algorithm described above, and sends the signal indicative of the product temperature to the display 150 such that the calculated product temperature is visible to consumers from outside the case 20.

Subsequent product temperatures taken at the specified time intervals are calculated by resetting the initial software simulated product temperature SST_1 prior to subsequent runs of the temperature algorithm. The calculated final software simulated product temperature SST_2 for the previous run of the temperature algorithm becomes the initial software simulated product temperature SST_1 for the next run of the temperature algorithm. The calculated final software simulated product temperature SST_2 is displayed on the screen 152 by the controller 155, and is further stored in the memory 160 of the controller 155 as a new initial software simulated product temperature SST_1. In other words, the value of the original initial software simulated product temperature SST_1 stored in the controller 155 is replaced by the value of the just-prior calculated final software simulated product temperature SST_2. The return air temperature TEMP_RA sensed by the return sensor 135 also can be stored in the memory 160, as well as other sensed characteristics of the case 20 (e.g., the various conditions sensed by the sensors 130, 135, 140, 145, etc.).

The controller 155 also includes a defrost algorithm that determines when to defrost the evaporator coil 64, and the duration that the evaporator coil 64 is defrosted. The temperature of the return air may rise when at least one of the doors 45 is open for an extended period of time (e.g., when product 15 is loaded onto the shelves 105). The defrost algorithm identifies a rise in the return air temperature by comparing the temperature sensed by the return sensor 135 with the temperature of the return air prior to the doors 45 being opened.

The defrost algorithm determines the amount of defrost of the evaporator 60 (i.e., the duration of the defrost) based on the signal from the defrost sensor 145.

FIGS. 5-10 show another embodiment of a refrigerated merchandiser 200 embodying the present invention for presenting the product 15 to consumers. Except as described below, the refrigerated merchandiser 200 is similar to the refrigerated merchandiser 10, and common elements are given the same reference numerals.

Figure 8:
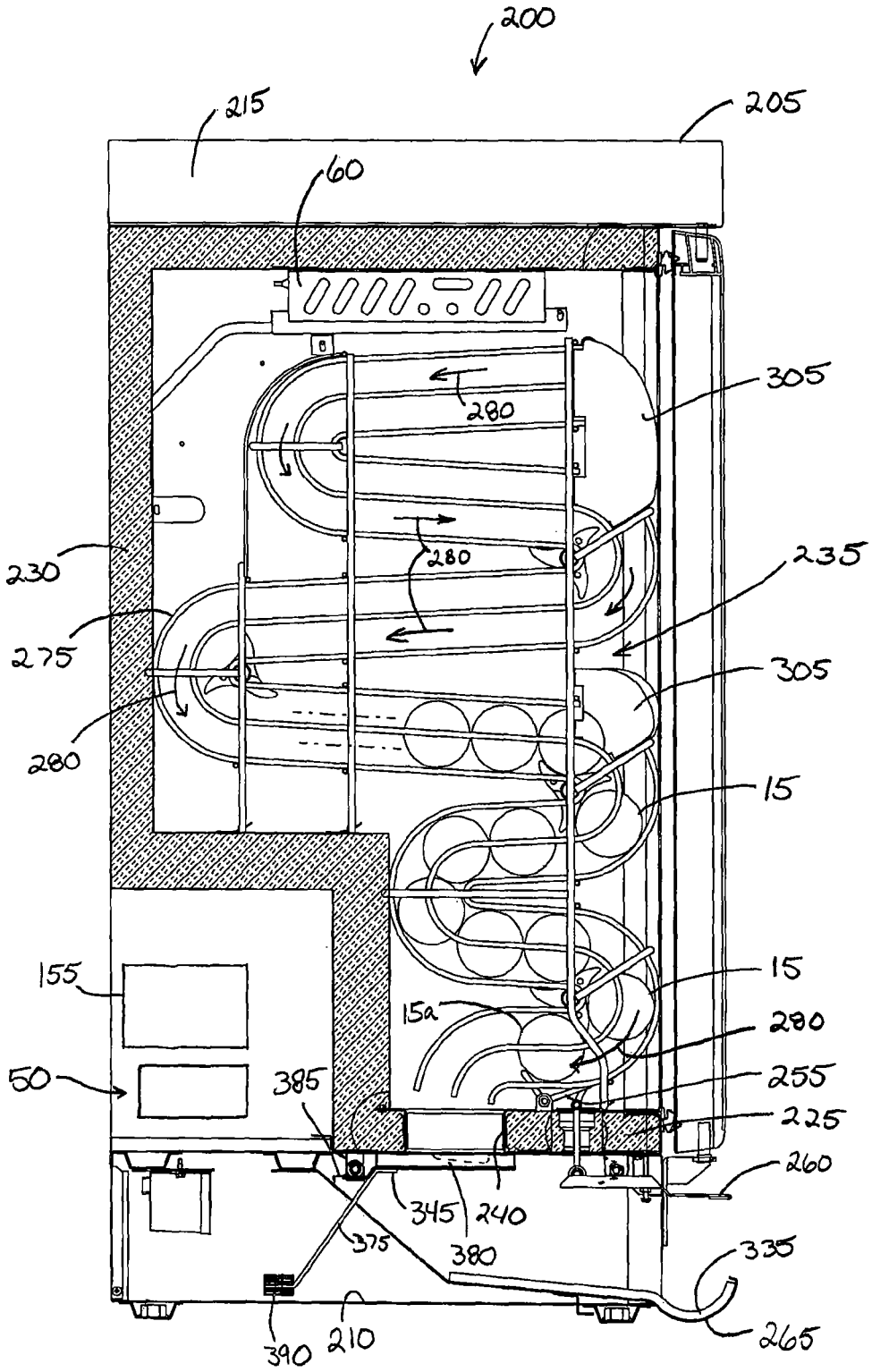
FIG. 8 is a cross-section view of the refrigerated merchandiser of FIG. 5 including a dispenser door located in a closed position and product stored in the dispenser rack prior to dispensation of the product from the dispenser rack.
Figure 9:
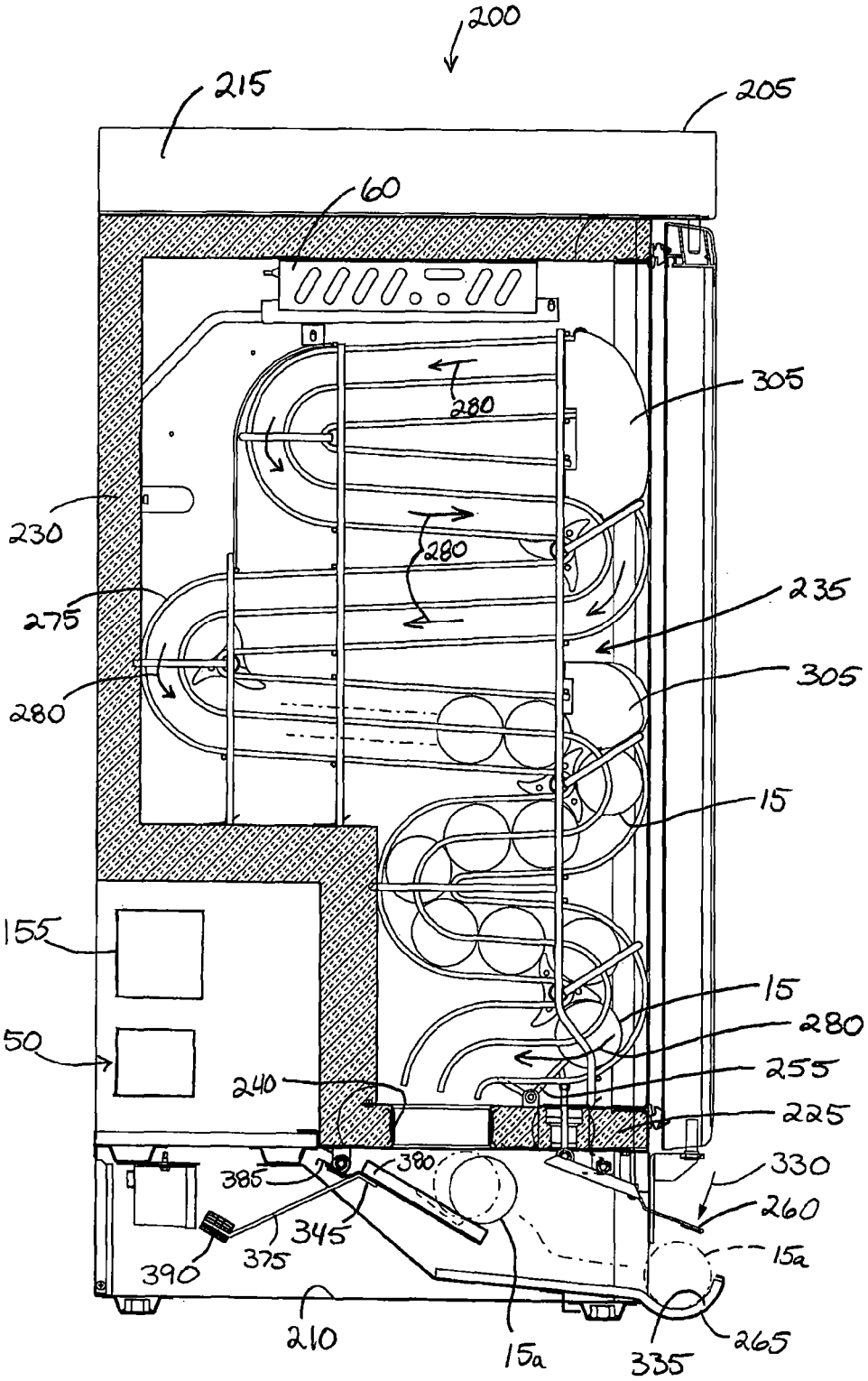
FIG. 9 is view similar to FIG. 8 including a dispenser door located in an open position and one product being dispensed from the dispenser rack.

FIGS. 5, 6, 8, and 9 show that the refrigerated merchandiser 200 includes a case 205 that has a base 210, a case top 215, side walls 220, a lower wall 225, and a rear wall 230. The area partially enclosed by the base, the case top 210, the side walls 215, the lower wall 225, and the rear wall 230 defines a product storage area 235 that stores the product 15. FIGS. 8 and 9 show that the lower wall 225 defines a product dispenser opening 240 that is adjacent a bottom of the product storage area 235.

The refrigerated merchandiser 200 includes the refrigeration system 50 to refrigerate the product 15, and the controller 155 to control the refrigeration system 50 and to receive signals from the sensors 130, 135, 140, 145, as well as other components of the refrigerated merchandiser 200. As discussed above with regard to FIGS. 1-4, the refrigeration system 50 is in fluid communication with the product storage area 235 to provide refrigerated air that refrigerates the product 15 to a temperature within the predetermined temperature range (e.g., 22-23 degrees Fahrenheit, etc.). The product 15 is maintained at temperatures within the predetermined temperature range so that the product 15 is most desirable to consumers without freezing the product.

Figure 5:
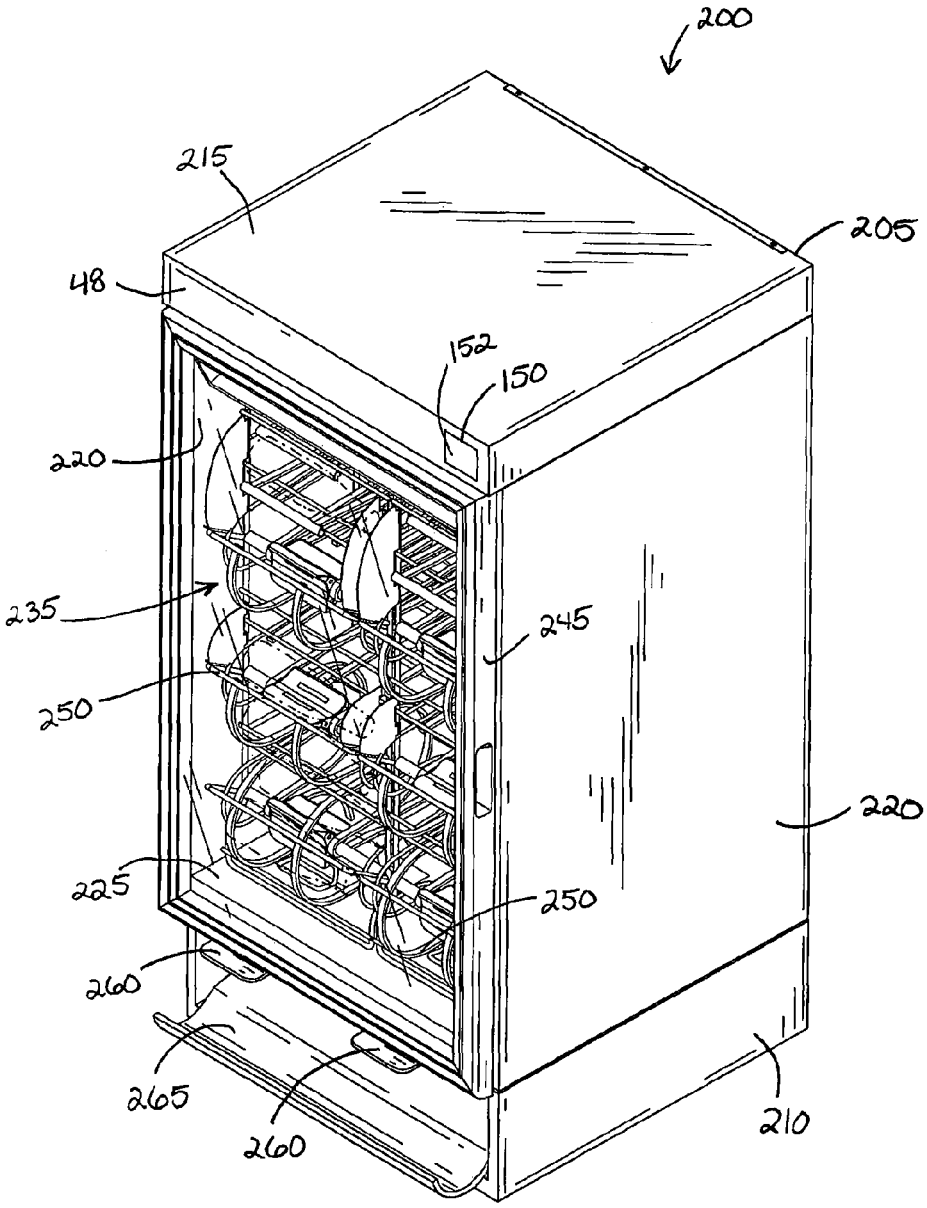
FIG. 5 is a perspective view of another refrigerated merchandiser embodying the present invention and including dispenser racks.
Figure 6:
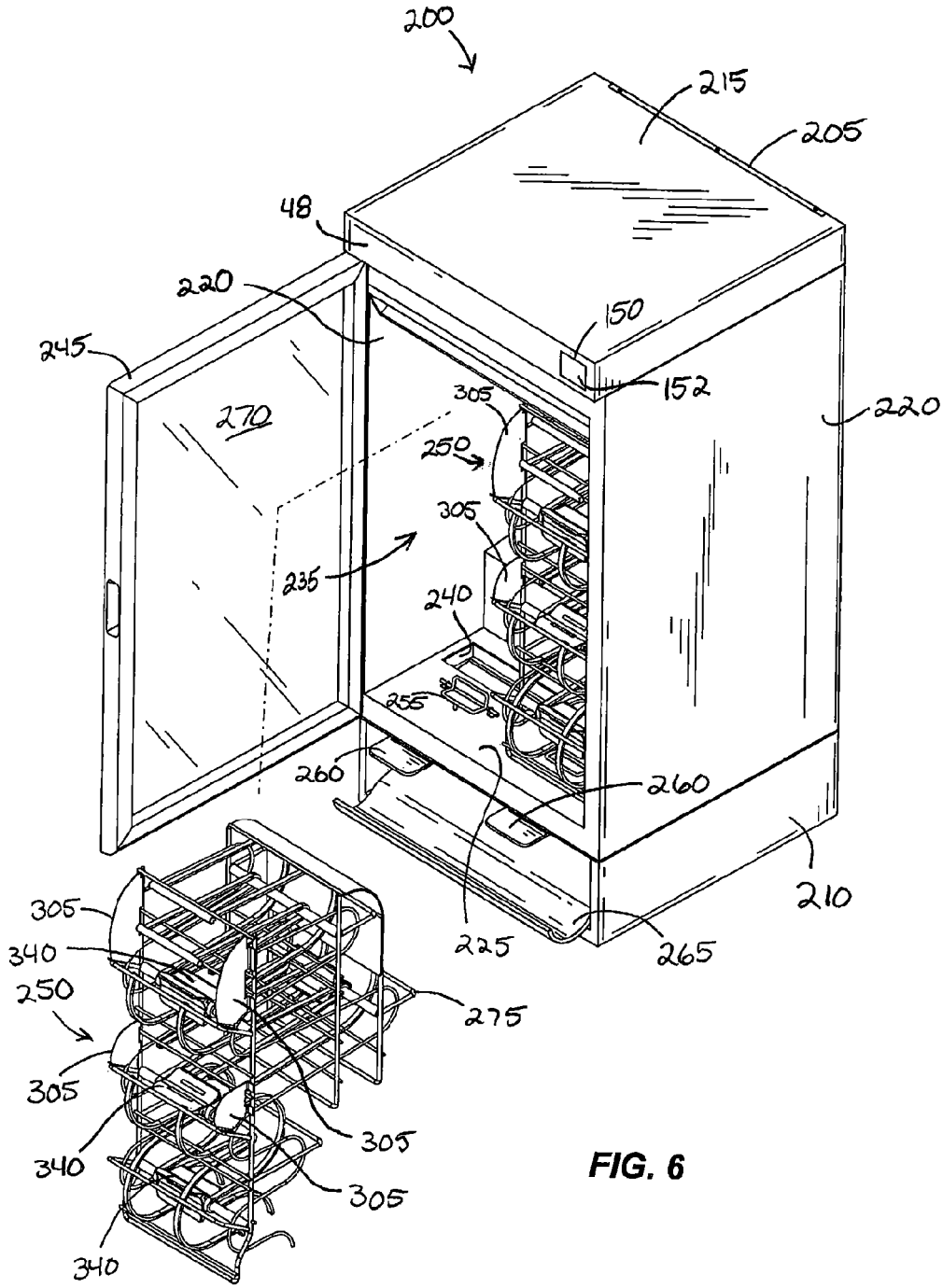
FIG. 6 is a partial exploded perspective view of the refrigerated merchandiser of FIG. 5 including the dispenser racks.

FIGS. 5 and 6 show that the refrigerated merchandiser 200 includes the display 150 and the light assembly 48 that are coupled to the case 20 adjacent a forward portion of the case top 210. In the illustrated construction, the display 150 is located on a right side of the light assembly 48. In other constructions, the display 150 can be located on the left side of the light assembly 48. Generally, the display 150 can be located anywhere on the case 205 such that the temperature of the product 15 can be visible to consumers.

The refrigerated merchandiser 200 also includes a door 245, dispenser racks or product supports 250, a dispenser mechanism 255, an operator mechanism or lever 260, and a product receiving tray 265. The 245 is pivotally attached to the case 205 and is movable between a closed position and an open position to allow access to the product storage area 235 for loading the product 15. The door 245 includes a glass member 270 that allows viewing of the product 15 by consumers from outside the case 205. In some constructions, the door 245 may include a coating that is electrically heated to limit condensation and fogging of the glass member 270 due to temperature variances that may exist between the product storage area 235 and an environment surrounding the refrigerated merchandiser 200. FIG. 6 shows that the door switch 47 can be positioned adjacent the door 245 to sense a position of the door 245.

The dispenser racks 250 are removably coupled to the case 205 within the product storage area 235 to dispense one product 15 at a time. The dispenser racks 250 can be attached to the lower wall 225 using fasteners or clips (not shown). FIGS. 6-9 show that each dispenser rack 250 includes a wireframe housing 275 that defines a product travel path 280 and that supports the product 15 within the product travel path 280. The wireframe housing 275 is formed from a plurality of wire members that can include metal, plastic, and/or other materials. In some constructions, the wireframe housing 275 can include a coating on the wire members to limit or reduce a speed of the product 15 as it travels along the product travel path 280 toward the dispenser opening 240.

The dispenser rack 250 is positioned in the case 205 so that an end of the product travel path 280 is disposed adjacent the product dispenser opening 240. The product travel path 280 is generally defined by a serpentine passage that alternatingly guides the product 15 in a generally downward direction toward the product dispenser opening 240. Generally, the product travel path 280 auto-feeds the product 15 downward toward the product dispenser opening 240. In the illustrated construction, the product travel path 280 alternatingly guides the product 15 toward the rear wall 230 and the door 245. In other constructions, the product travel path 280 may alternatingly guide the product 15 toward the side walls 215.

Figure 7:
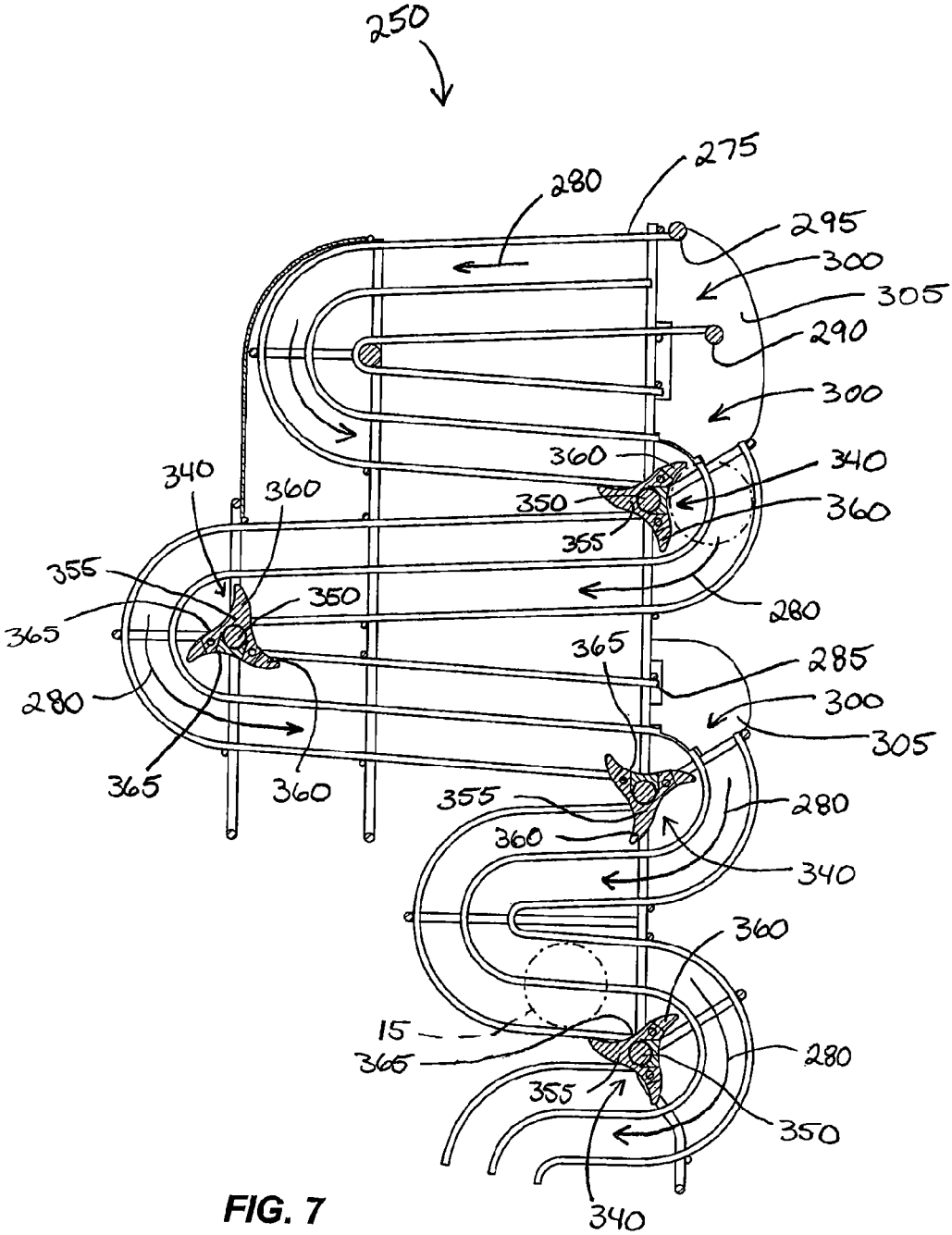
FIG. 7 is a cross-section view of one of the dispenser racks of FIG. 6.

FIG. 7 shows that the dispenser rack 250 also includes a first loading portion 285, a second loading portion 290, and a third loading portion 295 that allow the product 15 to be loaded into the wireframe housing 275 within the product travel path 280. The first, second, and third loading portions 285, 290, 295 are vertically spaced apart from each other within the wireframe housing 275. The first, second, and third loading portions 285, 290, 295 are further substantially vertically aligned with each other so that the product 15 can be loaded into the dispenser rack 250 at more than one location. As shown in FIG. 7, the first loading portion 285 is disposed vertically below the second loading portion 290 and the third loading portion 295. The second loading portion 290 is disposed vertically below the third loading portion 295. In some constructions, the dispenser rack 250 may include more or fewer than three loading portions.

Each of the first, second, and third loading portions 285, 290, 295 includes an opening 300 that receives the product 15 and that is in communication with the product travel path 280, and product guides 305 that guide the product 15 through the respective opening 300. The product guides 305 are positioned adjacent opposite ends of the opening 300 to engage the product 15 during insertion of the product 15 into the dispenser rack 250, and to align the product 15 with the product travel path 280 to avoid jamming of the product 15 during loading.

Figure 11:
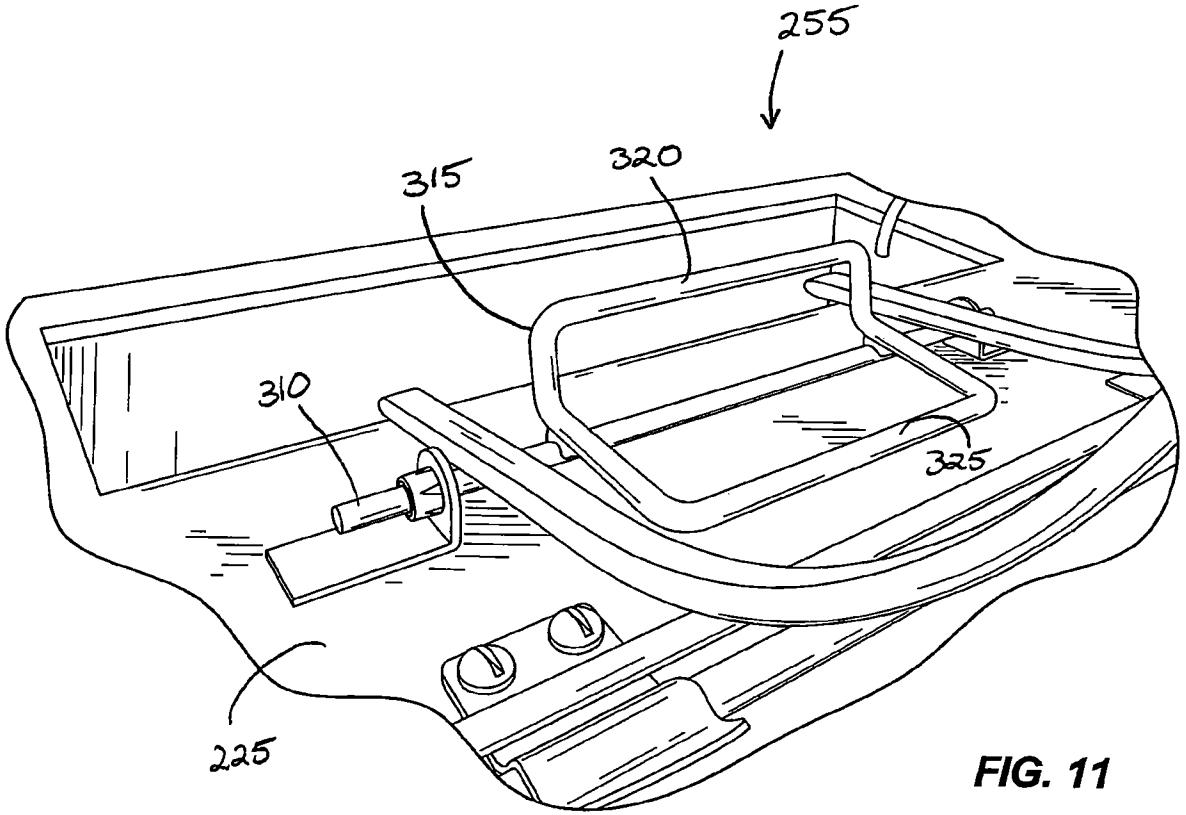
FIG. 11 is an enlarged perspective view of a portion of the refrigerated merchandiser of FIG. 5 including a dispenser mechanism.

FIGS. 6, 8, and 9 show that the dispenser mechanism 255 is disposed adjacent an end of the product travel path 280 and is in communication with the product dispenser opening 240 to selectively dispense the product 15 from the case 205. FIG. 11 shows that the dispenser mechanism 255 includes an axle 310 pivotably attached to the lower wall 225, and a dispensing portion 315 that is attached to the axle 310 for movement between a resting position and a dispensing position. The dispensing portion 315 defines an area in which one product 15 can be disposed prior to dispensation of the product 15 toward the product dispenser opening 240.

The dispenser portion 315 includes a first support 320 and a second support 325 that is angularly spaced from the first support 320 to hold the product 15 adjacent the product dispenser opening 240 when the dispenser mechanism 255 is in the resting position. In the illustrated construction, the second support 325 is angularly spaced from the first support 320 by approximately 90 degrees, although other angles between the first support 320 and the second support 325 are also possible. The first support 320 has a length, and the second support 325 has a length that is longer than the length of the first support 320. As described in detail below, the first support 320 is in communication with the product travel path 280 and is engaged with one product 15*a* disposed adjacent an end of the product travel path 280 to inhibit movement of the product 15*a* through the product dispenser opening 240 when the dispenser mechanism 255 is in the resting position. The second support 325 is in communication with the product travel path 280 when the dispenser mechanism 255 is in the dispensing position to inhibit movement of the product 15 into the dispenser portion 315 prior to dispensation of the single product 15*a* from the dispenser mechanism 255 toward the product dispenser opening 240.

FIGS. 5, 6, 8, and 9 show that the lever 260 is in communication with the dispenser mechanism 255 and is accessible from outside the product storage area 235 to dispense the product from the dispenser mechanism 255. In the illustrated construction, the lever 260 is mechanically attached to the dispenser mechanism 255. In other constructions, the lever 260 can be coupled to the dispenser mechanism 255 electrically or electromechanically. As shown in FIG. 9, the lever 260 is movable from an initial position in a generally downward direction by a force applied to an upper side of the lever 260, as indicated by the arrow 330. When the force is no longer applied to the lever 260, the lever 260 returns to the initial position.

The product receiving tray 265 is disposed adjacent a front portion of the case 205 below the lower wall 225, and is in communication with the product dispenser opening 240 to receive the product 15 that is dispensed from the dispenser rack 250. The tray 265 includes a product receiver 335 that is disposed on an outward end of the tray 265, and that has a curved shape. The tray 265 extends outward from the case 205 in a generally downward direction to direct the product 15 into the product receiver 335, and is accessible from outside the case 205 so that the dispensed product 15 can be retrieved. The product receiver 335 receives the dispensed product 15 without agitating the dispensed product 15. In some constructions, the product receiver 335 can include foam or other impact-softening material to avoid agitating the product 15.

The refrigerated merchandiser 200 also includes separators 340 and a dispenser door 345. FIGS. 7-9 show that the separators 340 are coupled to the dispenser rack 250 and are in communication with the product travel path 280. The separators 340 are spaced apart from each other along the product travel path 280. Each separator 340 extends across a substantial width of the product travel path 280 to direct the product downward along the product travel path 280. Generally, the separators 340 are located in the product travel path 280 where the serpentine passage changes direction. In other words, some of the separators 340 are located adjacent a curve in the product travel path 280 that is disposed near a front of the case 205. One separator 340 is located adjacent a curve in the product travel path 280 that is disposed near the rear wall 230. Depending on the overall height of the refrigerated merchandiser 200, additional separators 340 can be located adjacent the rear wall 230.

As shown in FIG. 7, each separator 340 is rotatable about an axle 350 that extends through a center portion of the separator 340 in response to engagement by the product 15 within the product travel path 280. The separators 340 are shaped to conform to the shape of the product 15. The separator 340 includes a body 355 and prong members 360 that extend from the body 355, and that define product receiving portions 365 that are curved to at least partially conform to the shape of the product 15. The prong members 360 have distal ends that extend into the product travel path 280 and that are in communication with the product 15 to guide movement of the product 15 along the product travel path 280. Generally, the prong members 360 engage the product 15 to limit a speed of the product 15 along the product travel path 280, and to inhibit jamming of the product 15 in the product travel path 280. The illustrated separator 340 includes a star shape defined by three prong members 360. In other constructions, the separator 340 may include additional prong members.

FIGS. 8 and 9 show that the dispenser door 345 is disposed adjacent the dispenser mechanism 255 and proximate to the product dispenser opening 240 to receive the product 15 dispensed from the dispenser rack 250. The dispenser door 345 is also in communication with the tray 265 to deliver the dispensed product 15 to the product receiver 335 for retrieval from outside the case 205.

Figure 10:
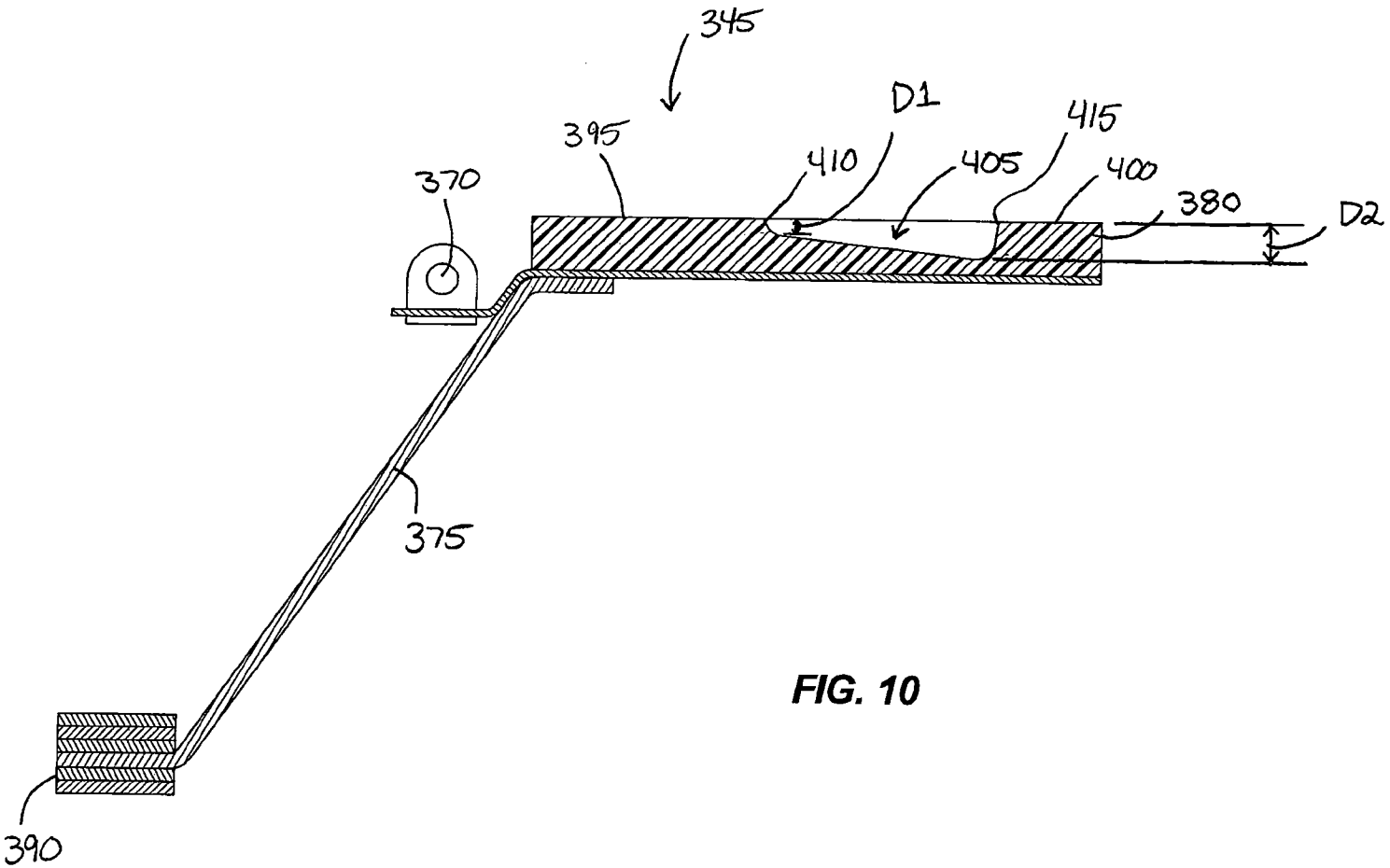
FIG. 10 is a cross-section view of the dispenser door of FIG. 8.

FIG. 10 shows that the dispenser door 345 includes an axle 370, a bracket 375, and a receiving portion 380. The axle 370 is pivotably coupled to the case 205 such that the dispenser door 345 is pivotable between a closed position and an open position about the axle 370. The dispenser door 345 substantially encloses the product dispenser opening 240 in the closed position to inhibit exposure of the product 15 in the product storage area 235 to ambient conditions. In some constructions, the dispenser door 345 includes a spring 385 that is coupled to the axle 370. The spring 385 biases the dispenser door 345 toward the closed position to maintain a relatively tight seal against the product dispenser opening 240.

As shown in FIGS. 8-10, the bracket 375 is coupled to the receiving portion 380 and extends from the receiving portion 380 toward a rear portion of the case 205. A counterweight 390 is attached to an end of the bracket 375 that is opposite the end of the bracket 375 that is coupled to the receiving portion 380. The counterweight 390 biases the dispenser door 345 toward the closed position. The spring 385 and the counterweight 390 cooperate to keep the dispenser door 345 in the closed position until one product 15 is dispensed by the dispenser mechanism 255. In other constructions, the spring 385 or the counterweight 390 can be used to bias the dispenser door 345 toward the closed position.

FIGS. 8 and 9 show that the receiving portion 380 is attached to an end of the bracket 375 opposite the end of the bracket 375 that includes the counterweight 390, and is disposed over the product dispenser opening 240 below the lower wall 225 to receive the product 15 dispensed by the dispenser mechanism 255. When the dispenser door 345 is in the open position, the receiving portion 380 is in close proximity to the tray 265 to gently direct the product 15 from the receiving portion 380 into the tray 265 without agitating the product 15. In some constructions, the receiving portion 380 may be spaced a short distance from the tray 265 when the dispenser door 345 is in the open position. In other constructions, the receiving portion 380 may be substantially engaged with the tray 265 when the dispenser door 345 is in the open position.

FIGS. 8-10 show that the receiving portion 380 includes a first edge portion 395 and a second edge portion 400 that is spaced apart from and substantially parallel to the first edge portion 395. A recess 405 is defined in the receiving portion 380 between the first edge portion 395 and the second edge portion 400. The receiving portion 380 is at least partially defined by foam to cushion the product 15 and to inhibit agitation of the product 15 when the product is dispensed through the product dispenser opening 240. Agitation of the unfrozen product 15 that includes a fluid or beverage at relatively cold temperatures can cause ice crystals to form in the fluid. These ice crystals can negatively affect the quality of the product 15, and can make the product 15 less desirable to consumers.

The recess 405 extends along a substantial length of the dispenser door 345 (i.e., along a width of the case 205) between the first edge portion 395 and the second edge portion 400. The recess 405 is defined by a first edge 410 that is disposed adjacent the first edge portion 395, and a second edge 415 that is disposed adjacent the second edge portion 400. The recess 405 has a first depth D1 along the first edge 410, and a second depth D2 along the second edge 415. As illustrated in FIG. 10, the first depth D1 is shallower than the second depth D2. In other words, the recess 405 extends generally downward from the first edge 410 toward the second edge 415. As described below, the recess 405 is shaped so that the product 15*a* that is dispensed by the dispenser mechanism 255 remains engaged with the receiving portion 380 within the recess 405 until a center of gravity of the product 15*a* extends beyond the second edge 415. The center of gravity of the product 15*a* is generally defined at a center point or axis of the product 15*a* when the product is viewed from adjacent an end of the product 15*a* (i.e., along a centerline extending along a length of the product 15*a*. In other constructions, the first depth D1 and the second depth D2 can be substantially equal.

In operation, the refrigeration system 50 is variable by the controller 155 between the first refrigeration mode, the second refrigeration mode, a null mode, and a defrost mode based on signals received from one or more of the discharge sensor 130 and the return sensor 135, as well as other sensed characteristics of the refrigerated merchandiser 10. The refrigeration modes are capable of lowering the temperature of the product 15 in a relatively short time (e.g., pull-down from 90 degrees Fahrenheit to 22 degrees Fahrenheit in about 12 hours).

The evaporation temperature of the evaporator 60 in the first and second refrigeration modes is based on the temperature of air that flows through the discharge outlet 100, and that is sensed by the discharge sensor 130. The evaporation temperature of the evaporator 60 in the first and second refrigeration modes is further based on the ambient air temperature that is sensed by the ambient sensor 140. The evaporation temperature is a function of the airflow temperature at the discharge outlet 100 such that a refrigerated airflow can be provided to the product storage area 40, 235 without freezing the product 15. In other words, the first and second refrigeration modes provide a refrigerated airflow to the product storage area 40, 235 at a temperature that is at or above a predetermined minimum temperature. The discharge sensor 130 can act as a safety device such that the controller 155 can maintain the temperature of the refrigerated airflow at the discharge outlet 100 at or above the predetermined minimum temperature.

The predetermined minimum temperature is determined by the freezing temperature of the product 15 stored in the case 20, 205. The discharge air temperature is maintained above the predetermined minimum temperature to inhibit freezing of the product 15 by regulating the evaporation temperature accordingly. In some constructions, the predetermined minimum temperature may be 10 degrees Fahrenheit. In other constructions, the predetermined minimum temperature may be above or below 10 degrees Fahrenheit, based on the freezing temperature of the product 15.

The controller 155 provides control of the product temperature in ambient conditions that may subject the case 20, 205 to a relatively large range of ambient temperatures (e.g., relatively low ambient temperatures and relatively high ambient temperatures). The controller 155 operates the refrigeration system 50 in the first refrigeration mode to maintain the product 15 within the predetermined temperature range when the temperature of the ambient air is above a predetermined temperature. Generally, temperatures above the predetermined temperature are considered relatively warm ambient conditions, and temperatures below the predetermined temperature are considered relatively cold ambient conditions. In some constructions, the predetermined temperature is above about 50 degrees Fahrenheit. In other constructions, the predetermined temperature can be within a range of temperatures between about 38 degrees Fahrenheit and 50 degrees Fahrenheit. In still other constructions, the predetermined temperature may include temperatures above 50 degrees Fahrenheit or below 38 degrees Fahrenheit.

In cold ambient conditions, the condensing temperature of the condenser 62 is reduced, which results in reducing the evaporation temperature needed to evaporate refrigerant flowing through the evaporator 60. As a result, the refrigeration system 50 more quickly refrigerates the airflow to a relatively low temperature. In some constructions, the controller 155 varies the refrigeration system 50 from the first refrigeration mode to the null mode when the temperature of the airflow at the discharge outlet 100 (sensed by the discharge sensor 130) drops below about the predetermined minimum temperature. The null mode is achieved by changing the state of the compressor 61 from an "ON" state to an "OFF" state. Once the temperature at the discharge outlet 100 rises above the predetermined minimum temperature, the controller 155 switches the refrigeration system 50 back to the first refrigeration mode. In some constructions, the controller 155 also can be used to vary the evaporator fans between an "ON" state to an "OFF" state to provide more control over the temperature of the air flowing through the discharge outlet 100 during the refrigeration and null modes, respectively.

In other constructions, the controller 155 varies the refrigeration system 50 from the first refrigeration mode to the second refrigeration mode when the sensed ambient air temperature is at or below the predetermined temperature to maintain the temperature of the product 15 within the predetermined temperature range while avoiding freezing the product 15. The refrigeration system 50 is varied between the first refrigeration mode and the second refrigeration mode by adjusting the compressor setpoints and/or the airflow temperature setpoint. When the ambient temperature is below the predetermined temperature, the controller 155 varies the refrigeration system 50 to the second refrigeration mode to operate the refrigeration system 50 at setpoints that are warmer than the setpoints in the first refrigeration mode, and that maintain the product temperature above the freezing temperature of the product 15. Once the ambient air temperature rises above the predetermined temperature, the controller 155 switches the refrigeration system 50 back to the first refrigeration mode.

In some constructions, the controller 155 may operate the refrigeration system 50 using a failsafe mode in the event of failure of one or more of the sensors 130, 135, 140, 145. The failsafe mode is defined by a backup refrigeration mode that operates the refrigeration system 50 in the absence of one or more signals from the sensors 130, 135, 140, 145. Generally, the controller 155 is in communication with the refrigeration system 50 to acquire data regarding operation of the refrigeration system 50 and to store the acquired data in the memory 160. The acquired data includes operating characteristics of the refrigeration system 50, such as an operating or run time of the compressor 61 (e.g., a recorded pull-down time, a recorded average compressor cycling interval one hour after defrost, etc.), a speed of the evaporator fan, and/or a speed of the condenser fan 63. The controller 155 initiates an alarm condition in response to failure of at least one of the sensors 130, 135, 140, 145 and operation of the refrigeration system 50 in the failsafe mode. After initiating the alarm, the controller 155 operates the refrigeration system 50 in the failsafe mode maintains the product 15 within the predetermined temperature range based on the acquired and memorized data.

The refrigeration system 50 is operable in the defrost mode based on timing with regard to when the product 15 is loaded onto the product supports 105, 250. The product 15 is loaded onto the product supports 105, 250 such that time is available to adequately cool the product 15 to a temperature within the predetermined temperature range. The doors 45, 245 can be open for a relatively long time duration when the product 15 is loaded onto the product supports 105, 250, which can cause the temperature of the product 15 to rise above the predetermined temperature range. The defrost mode may also increase the temperature of the product 15. Thus, it is preferred that the product 15 be loaded onto the product supports 105, 250 and the refrigeration system 50 operated in the defrost mode well in advance of making the product 15 available to consumers (i.e., a demand-defrost system). However, one of ordinary skill in the art will recognize that the product 15 can be loaded onto the product supports 105, 250 and the refrigeration system 50 can be operated in the defrost mode at any time (e.g., during peak and non-peak business periods).

In other constructions, the controller 155 may initiate the defrost mode using the door switch 47. In these constructions, the controller 155 is in communication with the door switch 47, and detects when the doors 45, 245 are in the open position and the closed position using the signal from the door switch 47. The defrost mode is initiated by the controller 155 in response to detection at least one of the doors 45, 245 in the open position for extended durations of time (e.g., one minute, two minutes, etc.). The refrigeration system 50 can be operated in the defrost mode for the same time interval that one or more of the doors 45, 245 are open, or for a different time interval.

In still other constructions, the defrost mode may be initiated by the controller 155 at periodic intervals over a predetermined duration of time (e.g., 24 hours, etc.) based on when the product 15 is loaded onto the shelves 105. In still other constructions, the controller 155 can enable the defrost mode at uneven time intervals. In these constructions, the defrost mode can be enabled such that the refrigeration system 50 is defrosted at times when there is low consumer demand (i.e., non-peak business periods) for the product 15. Defrosting the evaporator 60 during non-peak business periods provides cold product 15 during peak business periods (i.e., high consumer demand), that is desirable to consumers.

Generally, the refrigeration system 50 can be operated by the controller 155 in the defrost mode one or more times per day, depending on the buildup of frost on the evaporator 60. The number of times that the defrost mode is enabled by the controller 155 can be established or determined by an operator of the merchandiser 10. For example, the operator can program the defrost algorithm of the controller 155 based on conditions surrounding the merchandiser 10 and the number of times to defrost the evaporator 60 per time period (e.g., 24 hours).

The defrost algorithm can also be programmed to limit or restrict operation of the refrigeration system 50 in the defrost mode to avoid defrost of the evaporator 60 during peak business periods. The restricted operation of the refrigeration system 50 in the defrost mode can also limit too many defrost cycles in a predetermined period (e.g., 24 hours, etc.). For example, the controller 155 can operate the refrigeration system 50 in the defrost mode based on these peak business periods stored in the defrost algorithm. In some constructions, the defrost algorithm can include a minimum time duration between defrost mode operations.

The controller 155 initiates the defrost mode for a predetermined minimum time (e.g., 5 minutes, 10 minutes, etc.) once the defrost algorithm identifies a rise in the return air temperature (i.e., an indication that one or both of the doors 45, 245 are open). In some constructions, the defrost algorithm may determine a failsafe defrost time such that when no new product 15 is loaded onto the shelves 105 for an extended time duration (e.g., when the return air temperature remains relatively constant for the extended time duration), the controller 155 varies the refrigeration system 50 from one of the first refrigeration mode, the second refrigeration mode, and the null mode to the defrost mode in response to the signal indicative of the temperature of the evaporator coil 64 below a predetermined temperature. The controller 155 switches the refrigeration system 50 from the defrost mode to one of the first refrigeration mode, the second refrigeration mode, and the null mode in response to the signal indicative of the temperature of the evaporator coil 64 from the defrost sensor 145 above the predetermined temperature.

The refrigeration system 50 is operated in the first or second refrigeration mode to refrigerate the airflow generated by the evaporator fan using heat transfer with the refrigerant flowing through the evaporator 60. The temperature of the airflow generated by the refrigeration system 50 is determined by the temperature of the airflow at the discharge outlet 100 sensed by the discharge sensor 130, and by the temperature of the ambient air adjacent the case 20, 205. As long as the airflow temperature sensed at the discharge outlet 100 is above about the predetermined minimum temperature and the ambient air temperature is above the predetermined temperature, the refrigeration system 50 continues to operate in the first or second refrigeration mode. If the airflow temperature sensed at the discharge outlet 100 is below about the predetermined minimum temperature, the controller 155 varies the refrigeration system 50 from the first refrigeration mode to the null mode. If the ambient air temperature sensed by the ambient sensor 140 is below about the predetermined temperature, the controller 155 varies the refrigeration system 50 from the first refrigeration mode to the second refrigeration mode.

The refrigeration system 50 introduces the refrigerated airflow into the product storage area 40, 235 along the discharge passageway 115 to refrigerate the product 15, and receives the refrigerated airflow from the product storage area 40, 235 along the return passageway 120. The refrigerated airflow is directed by the evaporator fan toward the front wall 70, and further generally downward into the inlet passageway 90. The refrigerated airflow is deflected by the deflector 75 at the discharge outlet 100 away from the uppermost shelves 105 to avoid freezing the product 15 stored on the uppermost shelves 105. The refrigerated airflow is further directed by the deflector 75 toward the discharge passageway 115. The refrigerated airflow is evenly distributed within the product storage area 40, 235 from the discharge passageway 115. The refrigerated airflow is in heat exchange relationship with the product 15 to cool the product 15 to a temperature within the predetermined temperature range. The airflow warmed by the heat exchange with the product 15 is then directed toward the return passageway 120 and returns to the evaporator 60 to be cooled and recirculated.

The flow of air downward through the discharge passageway 115, through and over the product 15, and through the return passageway 120, defines a homogenous airflow that results in a relatively constant (i.e., stable) return air temperature and substantially laminar airflow when the doors 45, 245 are closed. In constructions that include the airflow control sheets, the high pressure and low pressure refrigerated airflow zones further contribute and define the homogenous airflow throughout the product storage area 40, 235. The relatively constant return air temperature provides more precise control of the temperature of the product 15 using the refrigeration system 50 and the controller 155. The airflow through the case 20, 205 and the control of the refrigeration system 50 provided by the controller 155 results in a substantially constant product temperature that is very close to the freezing temperature of the product 15 without freezing the product 15, and without adversely affecting defrost of the refrigeration system 10.

The multiple loading portions 285, 290, 295 of the refrigerated merchandiser 200 allow the product 15 to be loaded into the product travel path 280 at various locations on the dispenser rack 250. The product guides 305 prevent or inhibit jamming of the product 15 during loading of the product 15 by aligning the product with the product travel path 280. The multiple loading portions 285, 290, 295 also limit the distance that the product 15 travels within the product travel path 280 when the product 15 is loaded into the dispenser rack 250. The product 15 is loaded into the dispenser rack 250 by first passing the product 15 through the first loading portion 285 into the product travel path 280. The product 15 that is passed through the first loading portion 285 travels a relatively short distance along the product travel path 280 toward the product dispenser opening 240.

When the product 15 fills the portion of the product travel path 280 below the first loading portion 285, additional product 15 is loaded using the second loading portion 290. The product 15 that is loaded via the second loading portion 290 travels a relatively short distance along the product travel path 280 and engages the product 15 that was loaded via the first loading portion 285. When the product 15 fills the portion of the product travel path 280 below the second loading portion 290, additional product is loaded into the dispenser rack 250 using the third loading portion 295. The product 15 that is loaded via the third loading portion 295 travels a relatively short distance along the product travel path 280 and engages the product 15 that was loaded via the second loading portion 290. The separators 340 guide the product along the product travel path 280 toward the dispenser mechanism 255 and inhibit jamming of the product 15 along the product travel path 280. In this manner, agitation of the product 15 is substantially limited.

The product 15 is dispensed from the refrigerated merchandiser 200 via the dispenser mechanism 255, the operator mechanism, the tray 265, and the dispenser door 345. As shown in FIG. 8, one product 15*a* is disposed in the dispenser mechanism 255 when the dispenser mechanism 255 is in the resting position. The first support 320 is engaged with the one product 15*a* adjacent an end of the product travel path 280 to inhibit the product 15*a* from being dispensed from the dispenser rack 250 prior to engagement of the operator mechanism. The remaining product 15 extends upward along the product travel path 280 and behind the product disposed in the dispenser mechanism 255.

FIG. 9 shows the product 15*a* being dispensed from the dispenser rack 250. When the lever 260 is moved downward in the direction of the arrow 330, the dispenser mechanism 255 is pivoted about the axle 310 from the resting position to the dispensing position to dispense the one product 15*a*. The first support 320 is pivoted below the product travel path 280 to allow the product 15*a* to fall into and through the product dispenser opening 240. The second support 325 is pivoted into communication with the product travel path 280 when the dispenser mechanism 255 is moved to the dispensing position to inhibit movement of the product 15 into the dispenser mechanism 255 and through the product dispenser opening 240. After the lever 260 is released (i.e., the force applied on the lever 260 along the arrow 330 is removed), the dispenser mechanism 255 pivots back to the resting position. In the resting position, the first support 320 is again in communication with the product travel path 280, and the second support 325 is pivoted below the product travel path 280 to allow the next product 15 to move into the product receiving portion 380 and to engage the first support 320.

The product 15*a* dispensed from the dispenser rack 250 is received by the receiving portion 380. The foam cushions the relatively short fall of the product 15*a* through the product dispenser opening 240. The product 15*a* engages the first edge portion 395 and is further engaged with the receiving portion 380 within the recess 405. The weight of the product 15*a* overcomes the bias of the spring 385 and the counterweight 390 to move the dispenser door 345 to the open position. As the dispenser door 345 pivots downward from the closed position to the open position, the product 15*a* moves or rolls toward the second edge 415 of the recess 405, and substantially engages the second edge 415. The recess 405 is shaped so that the product 15*a* dispensed by the dispenser mechanism 255 remains engaged with the receiving portion 380 within the recess 405 until the dispenser door 345 reaches the open position.

When the dispenser door 345 is in the open position, the receiving portion 380 is in close proximity to the tray 265. The dispenser door 345 in the open position defines a generally downward slope relative to the tray 265. The product moves toward the tray 265 in response to movement of the dispenser door 345 in the generally downward direction toward the open position. The momentum of the product 15*a* within the recess 405 and the location of the center of gravity of the product relative to the second edge 415 cooperate to cause the product 15*a* to move or roll toward the tray 265. When the center of gravity of the product 15*a* extends beyond the second edge 415 of the recess 405, the product 15*a* rolls onto the tray 265 and is retained by the receiver tray 265 for retrieval. The proximity of the receiving portion 380 relative to the tray 265 when the dispenser door 345 is in the open position limits the distance that the product 15*a* travels, thus inhibiting agitation of the product 15*a*.

Various features and advantages of the invention are set forth in the following claims.

The invention claimed is:

1. A refrigerated merchandiser comprising:

a case defining a product storage area, the case including a door providing access to the product storage area, and at least one product support configured to support product in the product storage area;

a refrigeration system in communication with the product storage area, the refrigeration system including a refrigeration circuit having a compressor, a condenser, and an evaporator in series, the refrigeration system operable in a refrigeration mode configured to discharge a refrigerated airflow into the product storage area along a discharge passageway to refrigerate the product and to maintain the product within a predetermined temperature range without freezing the product, the refrigeration system configured to receive the refrigerated airflow from the product storage area along a return passageway, the refrigeration system further operable in a defrost mode configured to defrost the evaporator;

a sensor coupled to the case and configured to sense one or more defrost conditions of the case and to generate one or more signals indicative of the defrost conditions; and a controller in electrical communication with the sensor to receive the signals indicative of the defrost conditions, the controller in communication with the refrigeration system to control the refrigeration system in the refrigeration mode and in the defrost mode, the controller including an algorithm for calculating when to initiate the defrost mode, and for calculating a duration of the defrost mode, the controller programmed to vary the refrigeration system between the refrigeration mode and the defrost mode based on the signals indicative of the defrost conditions and the calculations by the algorithm.

2. The refrigerated merchandiser of claim 1, wherein the sensor is associated with the evaporator and the defrost conditions include a temperature of the evaporator, and wherein the sensor is configured to sense the temperature of the evaporator and to generate a signal indicative of the evaporator temperature.

3. The refrigerated merchandiser of claim 2, wherein the controller is programmed to vary the refrigeration system from the refrigeration mode to the defrost mode in response to the signal indicative of the evaporator temperature below a predetermined temperature.

4. The refrigerated merchandiser of claim 2, wherein the controller is programmed to vary the refrigeration system from the defrost mode to the refrigeration mode in response to the signal indicative of the evaporator temperature above a predetermined temperature.

5. The refrigerated merchandiser of claim 4, wherein the controller is programmed to operate the refrigeration system in the refrigeration mode for a predetermined minimum time after operation of the refrigeration system in the defrost mode to maintain the product within a predetermined temperature range.

6. The refrigerated merchandiser of claim 1, wherein the sensor is in communication with the return passageway and the defrost conditions include a temperature of the refrigerated airflow in the return passageway, and wherein the sensor is configured to sense a temperature of the refrigerated airflow and to generate a signal indicative of the return airflow temperature.

7. The refrigerated merchandiser of claim 6, wherein the controller is configured to identify a rise in the return airflow temperature using the algorithm based on the signal indicative of the return airflow temperature, and wherein the controller is programmed to initiate the defrost mode for a predetermined time duration in response to identification of a rise in the return airflow temperature above a predetermined value.

8. The refrigerated merchandiser of claim 7, wherein the rise in the return airflow temperature is caused by the door positioned in an open position.

9. The refrigerated merchandiser of claim 8, wherein the controller is programmed to identify the rise in the return airflow temperature using the algorithm by comparing the return airflow temperature sensed when the door is in the open position with the return airflow temperature sensed prior to the door being in the open position.

10. The refrigerated merchandiser of claim 1, wherein the sensor includes a door switch positioned adjacent the door and the defrost conditions include a position of the door, and wherein the door switch is configured to sense the door in the open position, and to generate a signal indicative of the door in the open position.

11. The refrigerated merchandiser of claim 10, wherein the controller is in communication with the door switch to receive the signal indicative of the door in the open position, and wherein the controller is programmed to vary the refrigeration system from the refrigeration mode to the defrost mode for a predetermined time duration based on the signal indicative of the door being in the open position.

12. The refrigerated merchandiser of claim 11, wherein the refrigeration system is operable in the defrost mode for the same time duration that the door is in the open position.

13. The refrigerated merchandiser of claim 1, wherein the controller is programmed to initiate the defrost mode at periodic intervals based on when the product is loaded into the product storage area.

14. The refrigerated merchandiser of claim 1, wherein the controller is programmed to initiate the defrost mode at uneven time intervals so that the condenser is defrosted when there is low consumer demand for the product.

15. The refrigerated merchandiser of claim 1, wherein the controller is programmed to vary the refrigeration system from the refrigeration mode to the defrost mode and to operate the refrigeration system in the defrost mode for a predetermined defrost time in response to an extended time duration determined by the controller in which no product is loaded into the product storage area.

16. The refrigerated merchandiser of claim 1, wherein when the defrost conditions are indicative of accumulation of frost on the evaporator, the controller is programmed to vary the refrigeration system from the refrigeration mode to the defrost mode for a predetermined time duration to defrost the evaporator.

* * * * *